US009802685B2

(12) United States Patent
Kent

(10) Patent No.: US 9,802,685 B2
(45) **Date of Patent: *Oct. 31, 2017**

(54) FLOTATION SAFETY SYSTEM

(71) Applicant: David G. Kent, Morehead City, NC (US)

(72) Inventor: David G. Kent, Morehead City, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/543,283

(22) Filed: Nov. 17, 2014

(65) Prior Publication Data

US 2016/0347431 A1 Dec. 1, 2016

Related U.S. Application Data

(60) Provisional application No. 61/905,723, filed on Nov. 18, 2013.

(51) Int. Cl.
*B63C 9/125* (2006.01)
*F41H 1/02* (2006.01)

(52) U.S. Cl.
CPC ..... *B63C 9/1255* (2013.01); *F41H 1/02* (2013.01)

(58) Field of Classification Search
CPC ..... B63C 9/1255; F41H 1/02
USPC ..... 441/115
See application file for complete search history.

(56) References Cited

U.S. PATENT DOCUMENTS 4,024,440 A * 5/1977 Miller ..... B63C 9/24 137/392
4,864,656 A * 9/1989 Nesse ..... A41D 3/00 2/108
5,385,496 A * 1/1995 Seligman ..... B63C 9/1055 405/186
5,456,623 A * 10/1995 Norris ..... B63C 9/155 441/106
5,584,737 A * 12/1996 Luhtala ..... A41D 13/0125 2/2.5
5,996,115 A * 12/1999 Mazelsky ..... F41H 1/02 2/2.5
6,070,274 A 6/2000 van der Sleesen
6,203,246 B1 * 3/2001 Courtney ..... B63C 9/1255 405/185
6,389,594 B1 5/2002 Yavin
6,408,733 B1 * 6/2002 Perciballi ..... F41H 5/0435 2/2.5
6,478,510 B1 * 11/2002 Young ..... B63C 11/08 405/186
6,681,399 B1 * 1/2004 Kerr ..... A41D 13/0125 2/2.5

(Continued)

OTHER PUBLICATIONS

U.S. Appl. No. 15/367,561, filed Dec. 2, 2016.

*Primary Examiner* — Lars A Olson
*Assistant Examiner* — Jovon Hayes
(74) *Attorney, Agent, or Firm* — McLane, Middleton, Professional Association

(57) ABSTRACT

An improved flotation safety system includes a self-righting plate carrier with inflatable tactical aid. The system herein may advantageously be used by military personnel including covert war fighters, combat swimmers, maritime airborne operations personnel, and others. The flotation safety system herein includes buoyancy compensators to offset the wearer's equipment load and emergency self-righting flotation to provide positive buoyancy to the wear.

50 Claims, 35 Drawing Sheets

(56) References Cited

U.S. PATENT DOCUMENTS

| | | | | |
|---|---|---|---|---|
| 6,805,519 | B1 * | 10/2004 | Courtney | B63C 9/08 405/185 |
| 6,997,218 | B1 | 2/2006 | Garcia et al. | |
| 7,080,411 | B2 | 7/2006 | Kerr | |
| 7,210,390 | B1 | 5/2007 | Olson et al. | |
| 7,261,608 | B2 * | 8/2007 | Haddacks | A41D 13/018 2/455 |
| 7,335,078 | B2 * | 2/2008 | Kent | B63C 9/08 441/108 |
| 7,917,967 | B2 * | 4/2011 | Osborne | F41H 1/02 2/2.5 |
| 8,808,048 | B2 | 8/2014 | Kent | |
| 9,340,266 | B2 | 5/2016 | Kent | |
| 9,366,505 | B2 * | 6/2016 | Kent | F41H 1/02 |
| 2004/0157514 | A1 * | 8/2004 | Courtney | B63C 9/081 441/88 |
| 2012/0289106 | A1 | 11/2012 | Kent | |
| 2013/0212764 | A1 * | 8/2013 | Kent | F41H 1/02 2/2.5 |
| 2014/0322999 | A1 | 10/2014 | Kent | |
| 2016/0347431 | A1 * | 12/2016 | Kent | F41H 1/02 |
| 2016/0370150 | A1 | 12/2016 | Kent | |

* cited by examiner

FLOTATION SAFETY SYSTEM

CROSS REFERENCE TO RELATED APPLICATION

This application claims the benefit of priority of U.S. provisional patent application No. 61/905,723 filed Nov. 18, 2014. The aforementioned provisional application is incorporated herein by reference in its entirety.

INCORPORATION BY REFERENCE

This application is related to U.S. patent application Ser. No. 13/468,829 filed May 10, 2012, U.S. provisional patent application No. 61/484,394 filed May 10, 2011, U.S. patent application Ser. No. 13/770,375 filed Feb. 19, 2013, and U.S. provisional patent application No. 61/599,711 filed Feb. 16, 2012. Each of the aforementioned applications is incorporated herein by reference in its entirety. The entire contents of the Kraken™ Self-Righting Plate Carrier Manual by First Spear, LLC dated July 2014 is also incorporated herein by reference in its entirety.

BACKGROUND

The present disclosure relates to an improved flotation safety system. More particularly, the present development related to a self-righting plate carrier providing inflatable tactical aid and may advantageously be used by military personnel including covert war fighters, combat swimmers, maritime airborne operations personnel, and others. The flotation safety system herein includes buoyancy compensators to offset the wearer's equipment load and emergency self-righting flotation to provide positive buoyancy to the wear.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
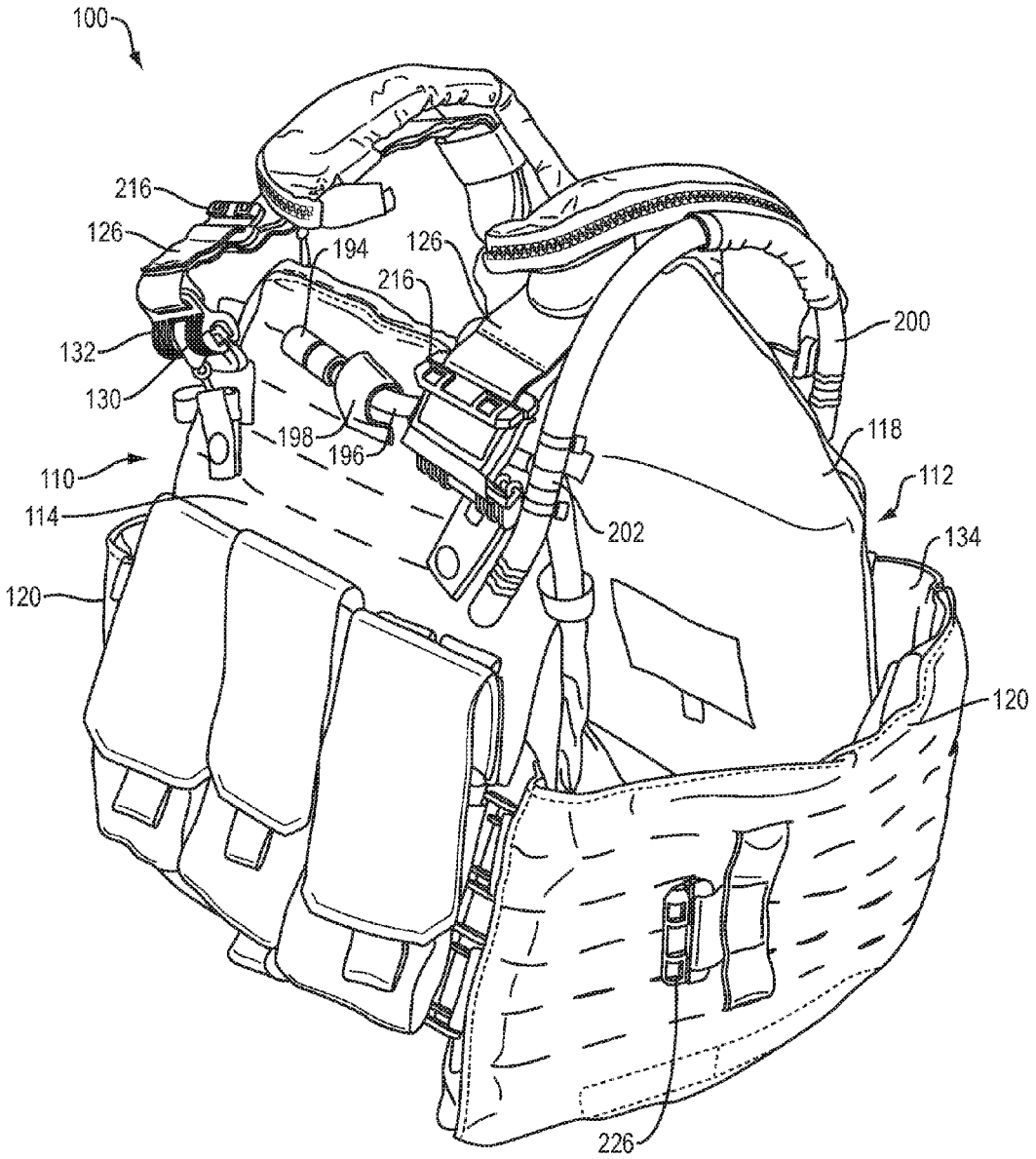
FIG. 1 is a perspective view of a flotation safety vest according to an exemplary embodiment.
Figure 2:
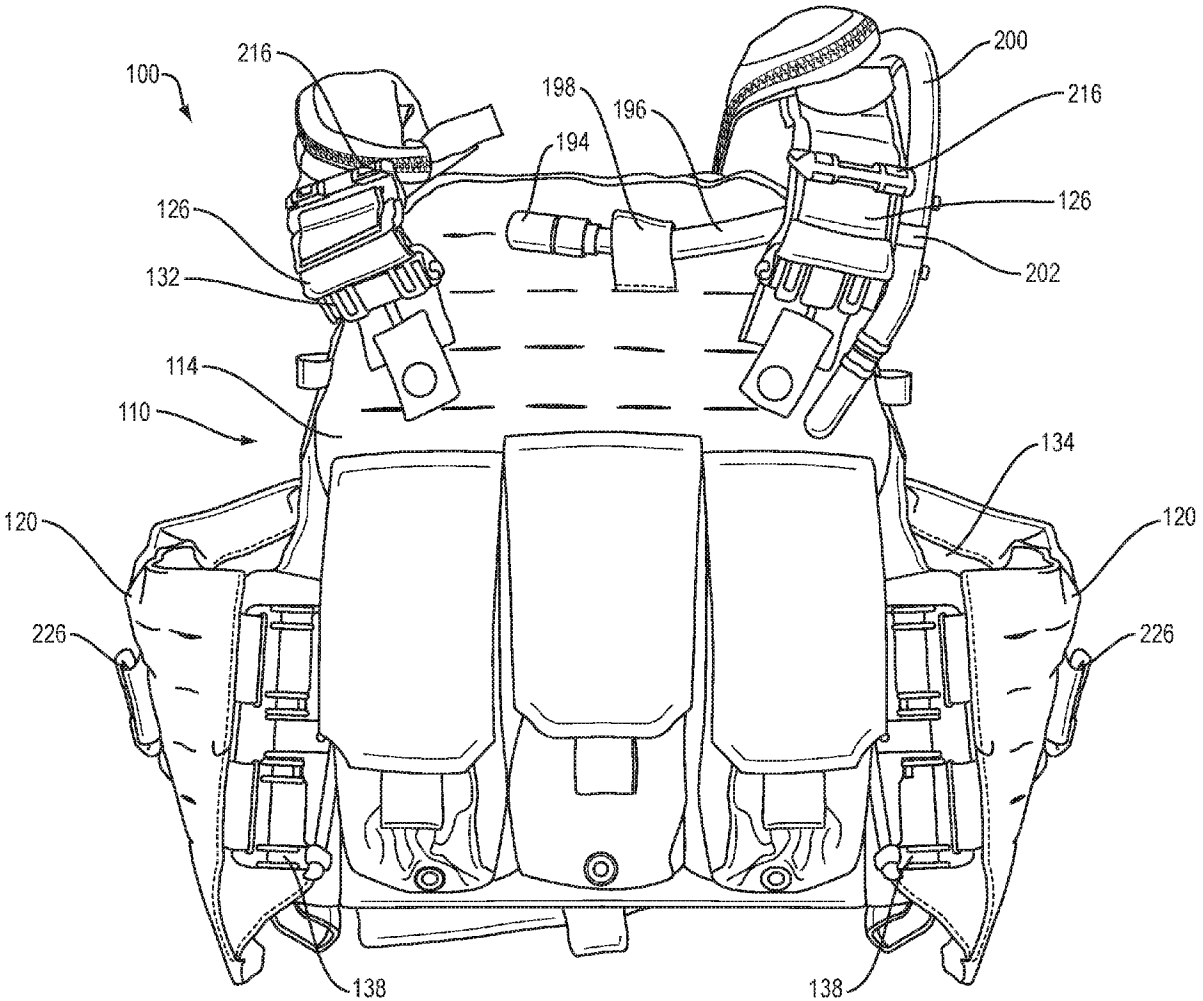
FIG. 2 is a front view of the vest appearing in FIG. 1.
Figure 3:
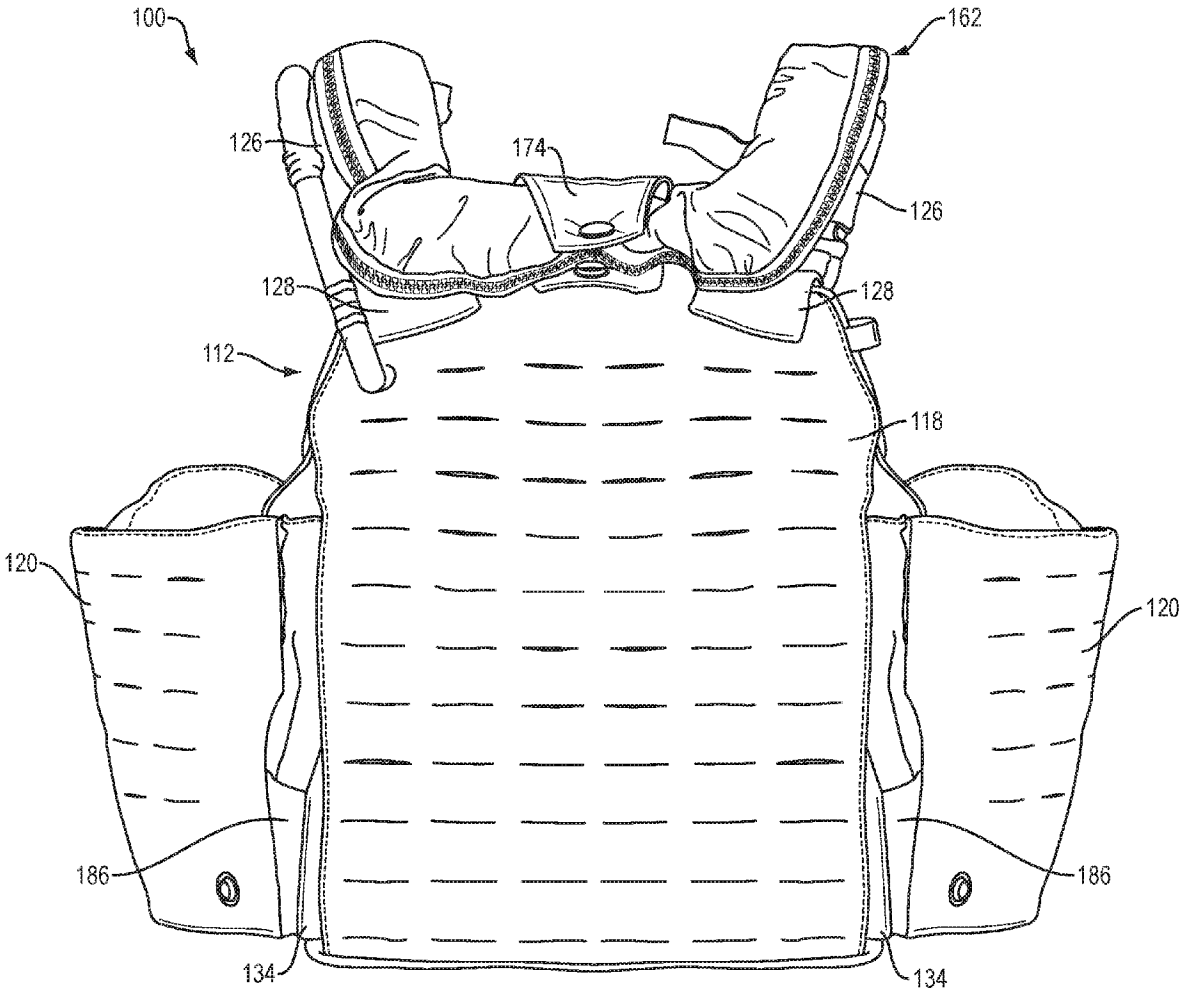
FIG. 3 is a rear view of the vest appearing in FIG. 1.
Figure 4:
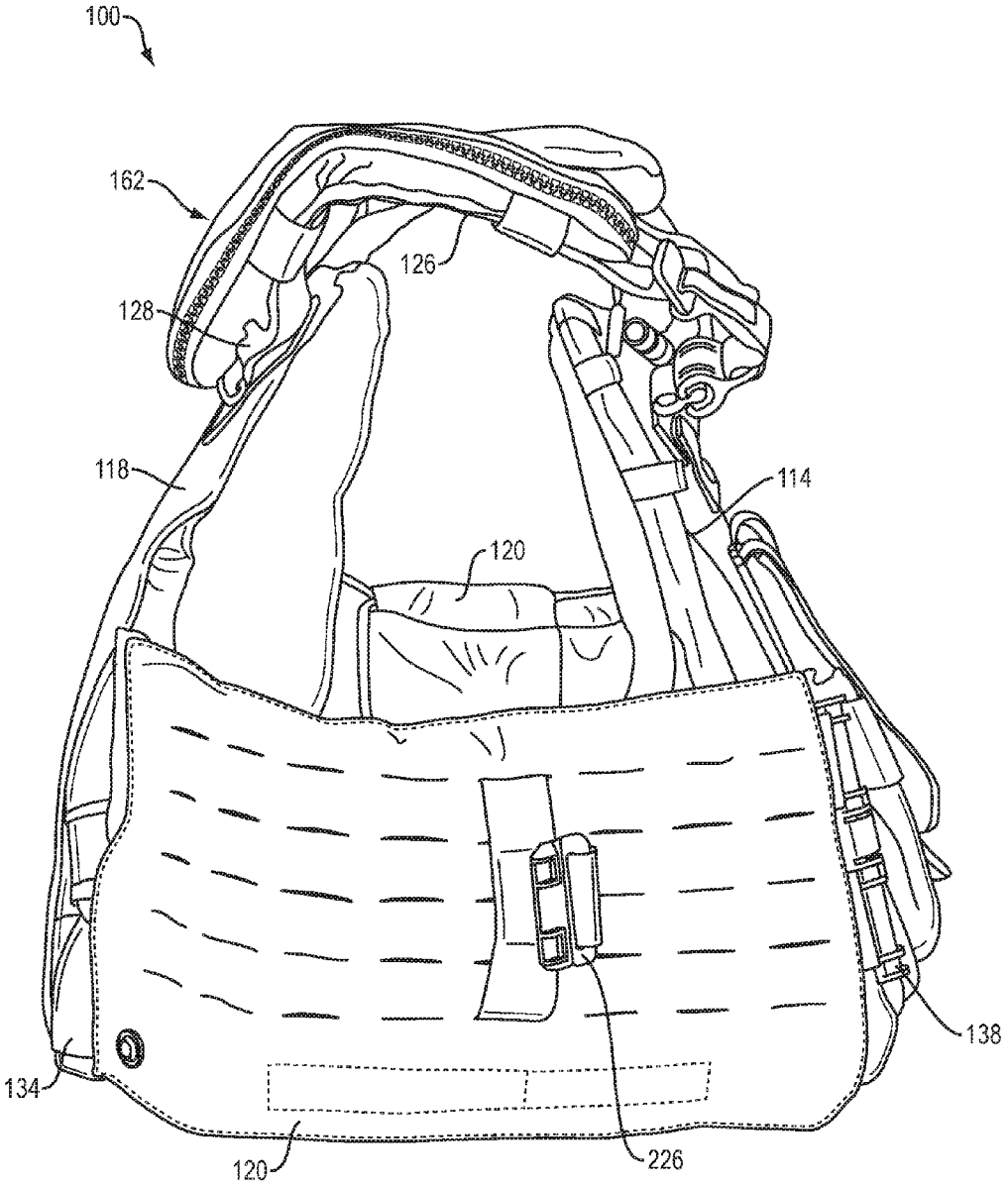
FIG. 4 is a right side view of the vest appearing in FIG. 1.
Figure 5:
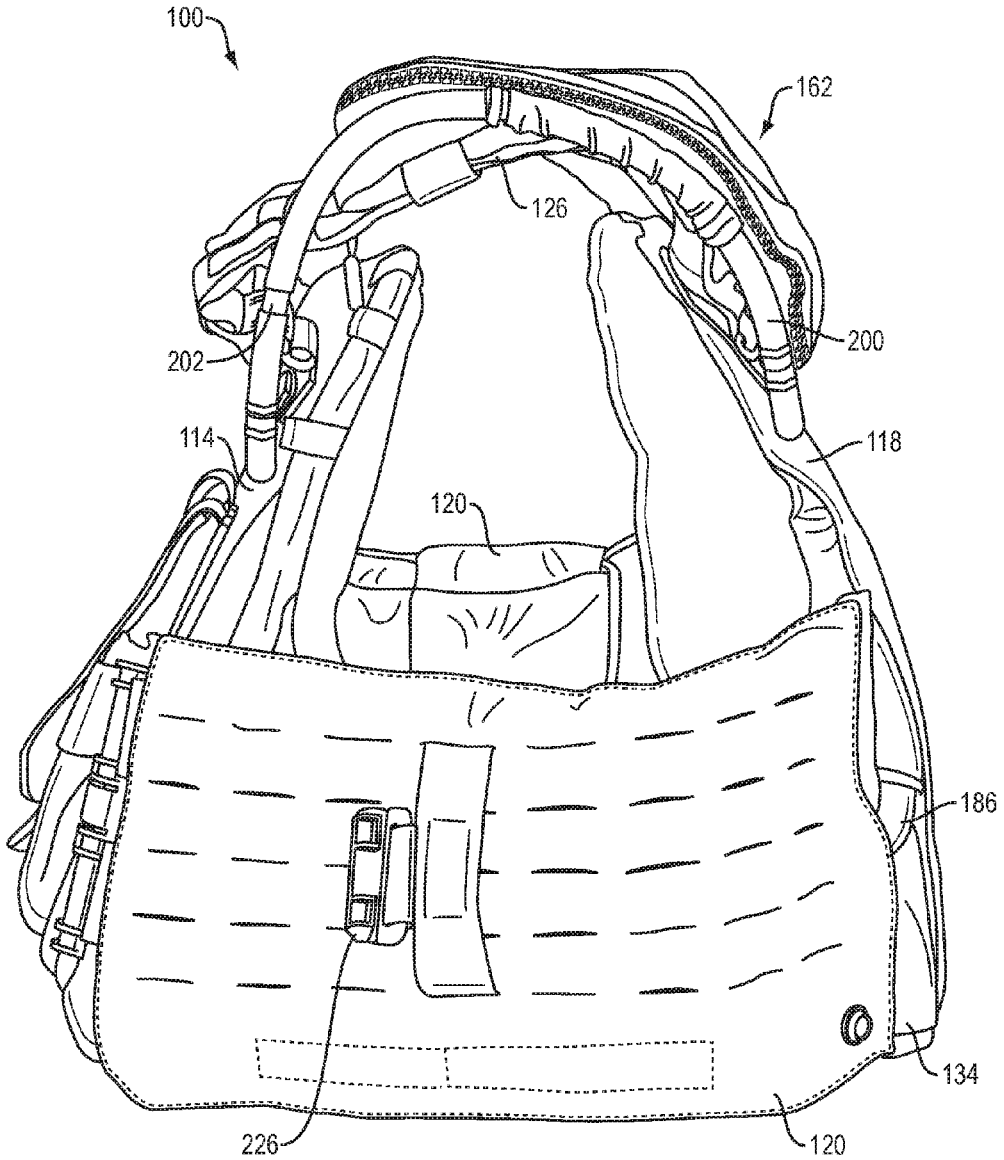
FIG. 5 is a left side view of the vest appearing in FIG. 1.
Figure 6:
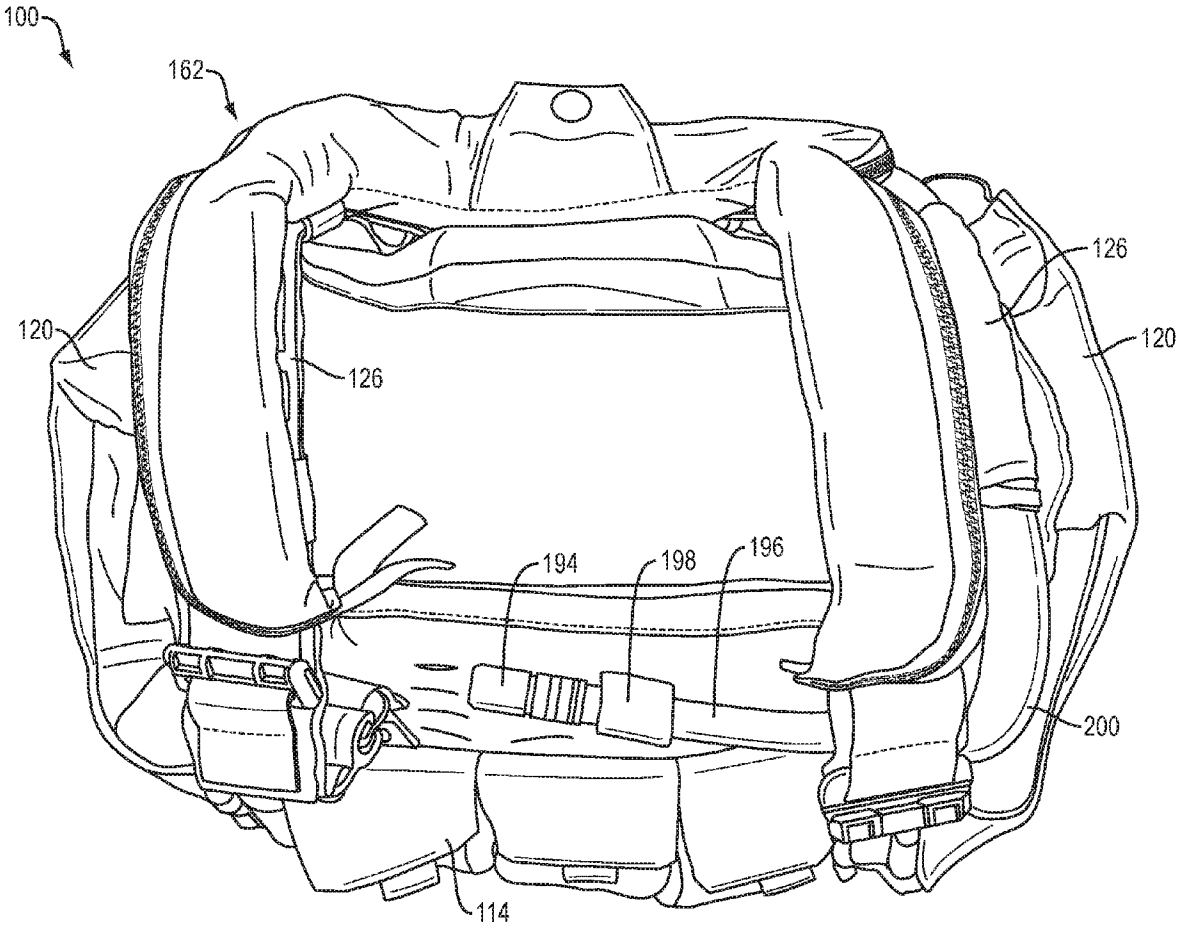
FIG. 6 is a top view of the vest appearing in FIG. 1.
Figure 7:
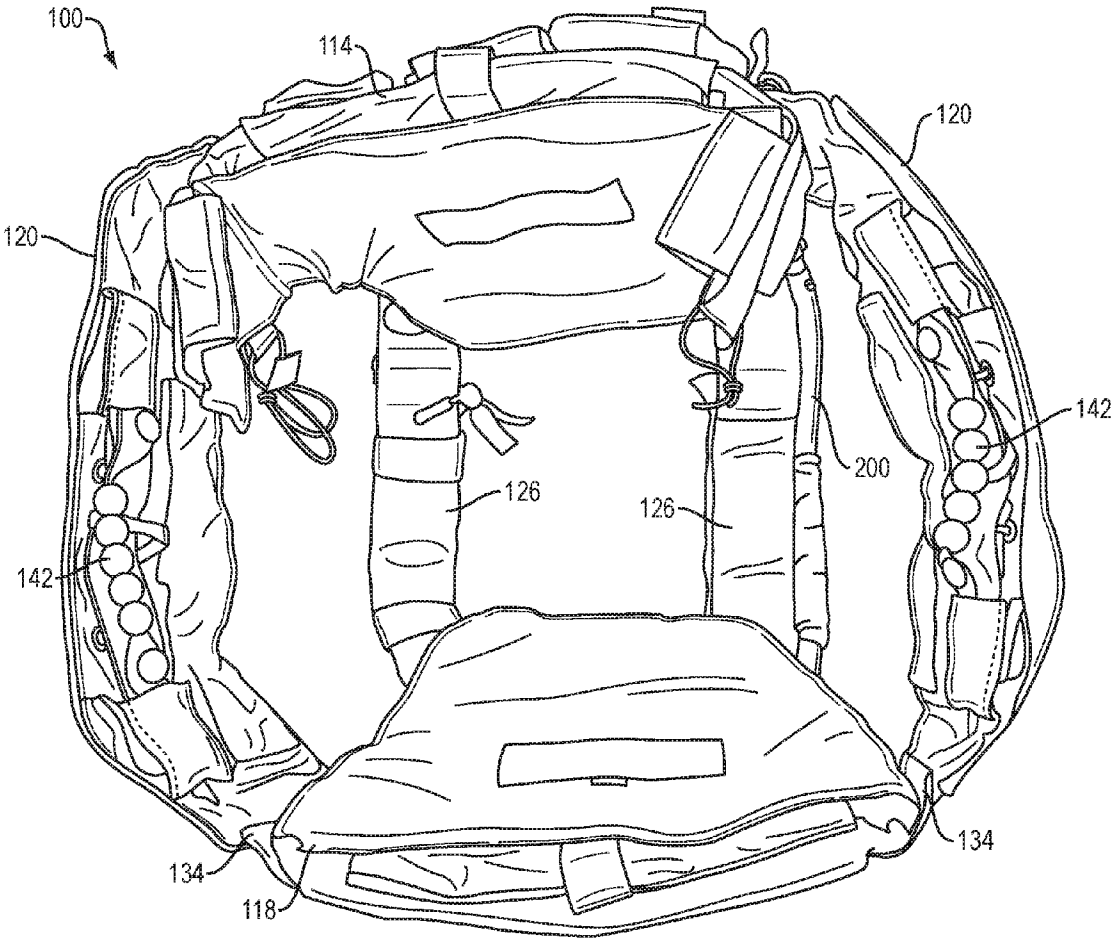
FIG. 7 is a bottom view of the vest appearing in FIG. 1.
Figure 8:
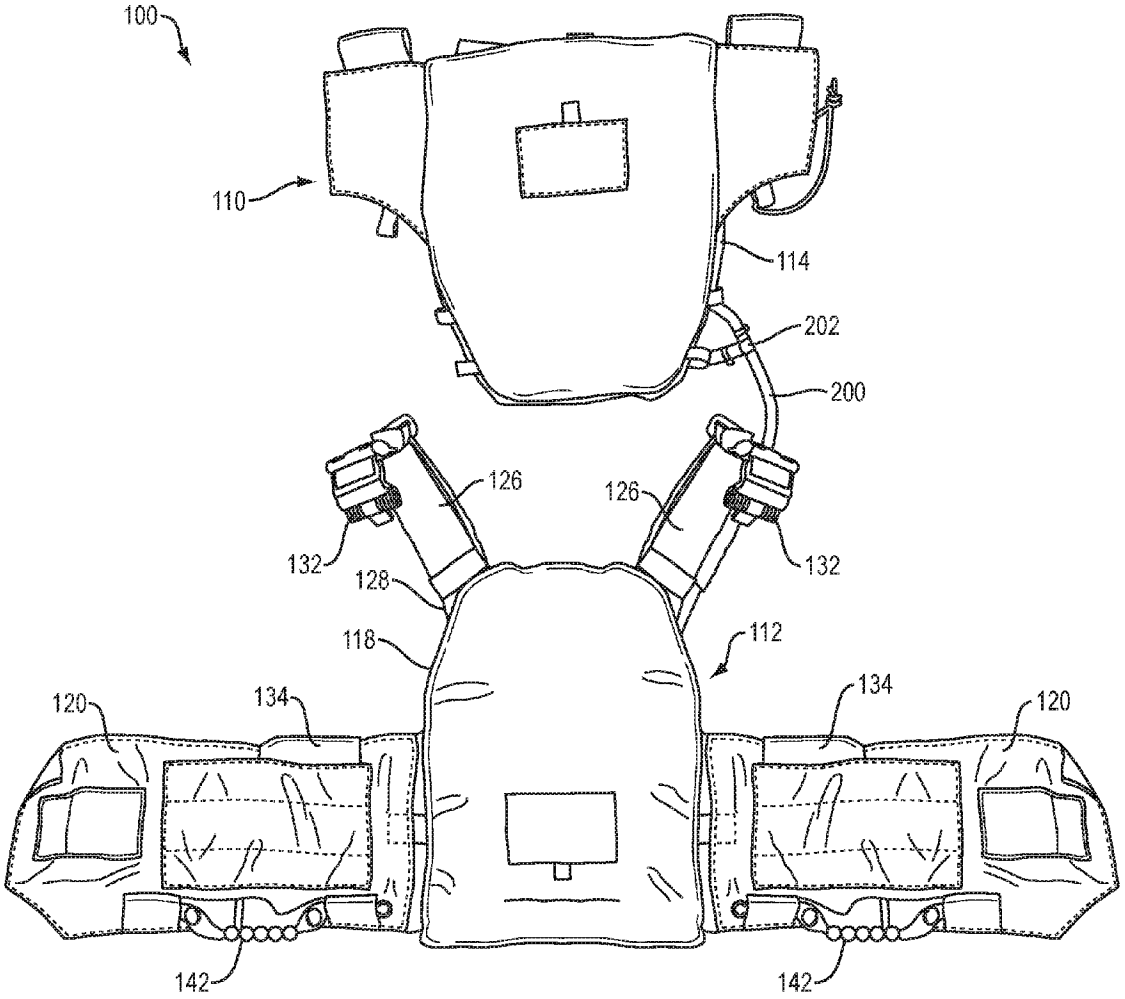
FIG. 8 is an exploded view showing the front section detached from the rear section and showing the interior of the front and rear sections.
Figure 9:
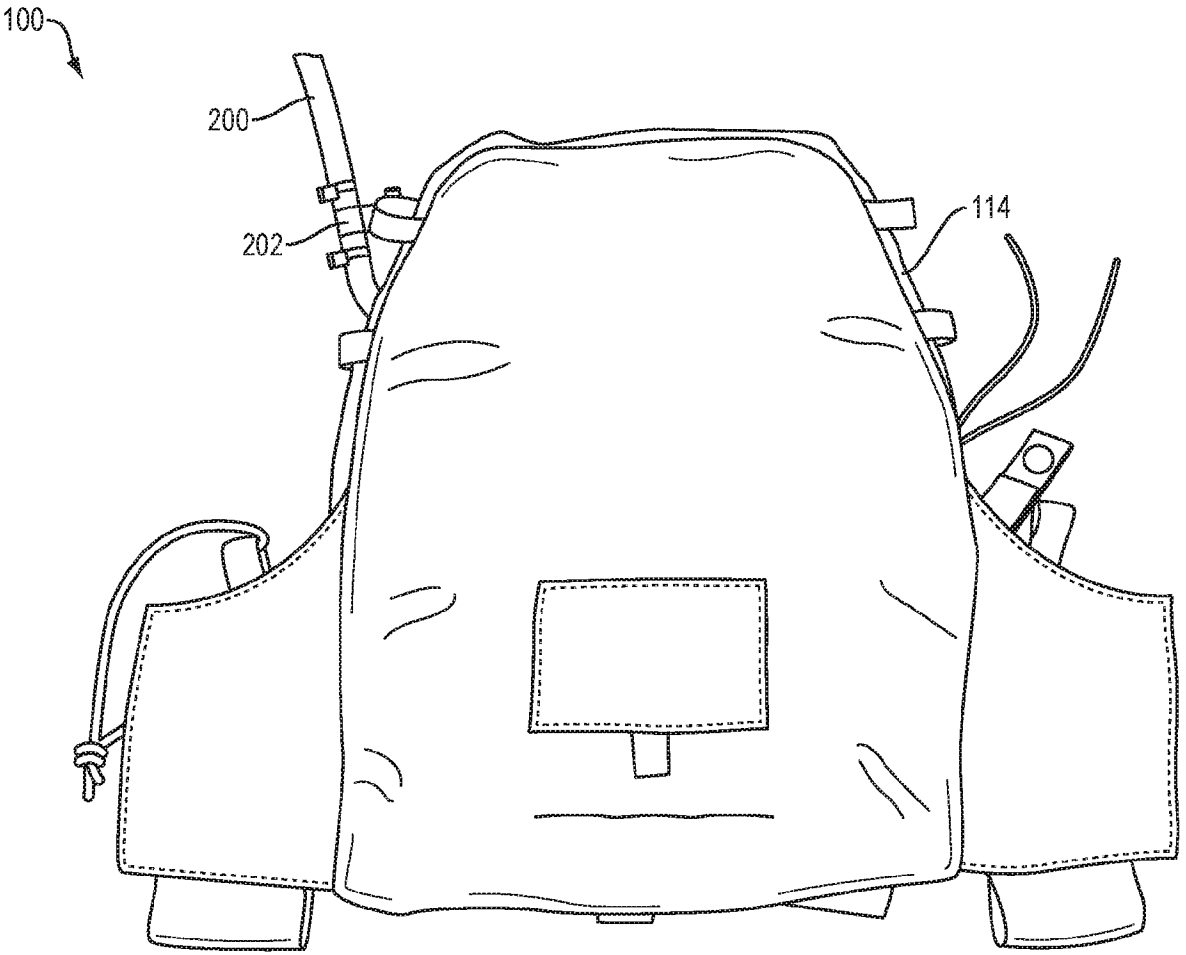
FIG. 9 is an enlarged view showing the interior surface of the front section.
Figure 10:
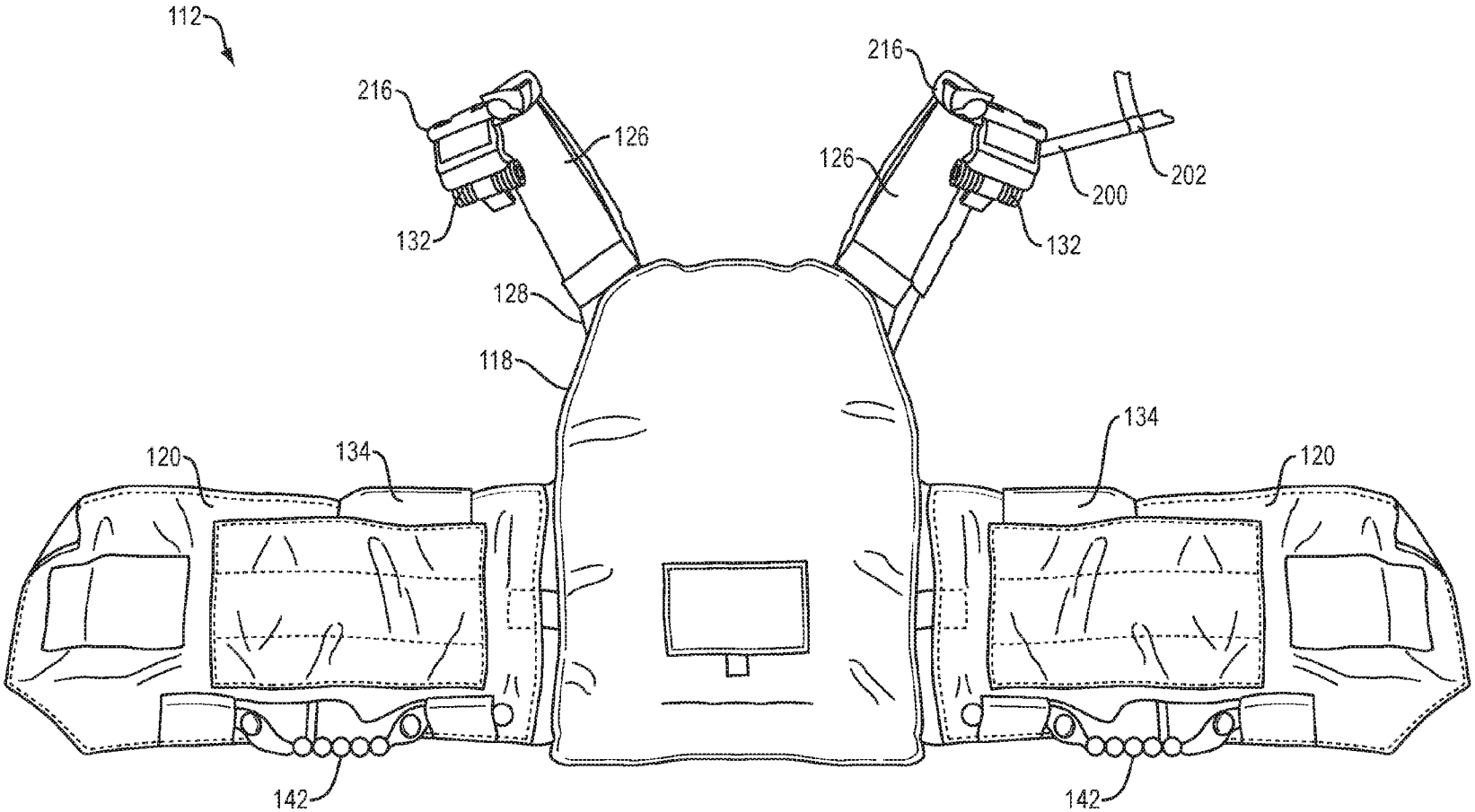
FIG. 10 is an enlarged view showing the interior surface of the rear section.
Figure 11:
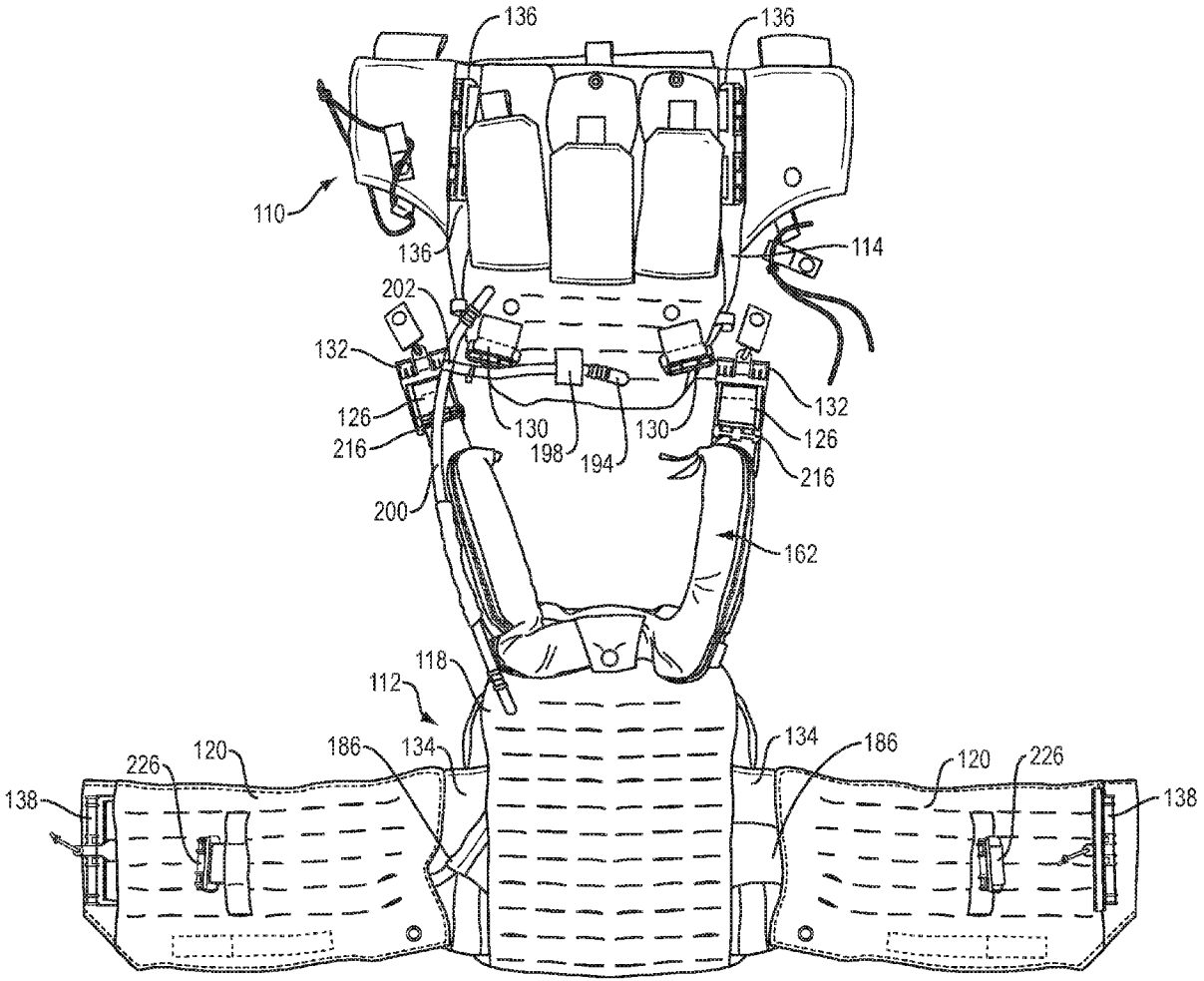
FIG. 11 is an exploded view showing the front section detached from the rear section and showing the exterior of the front and rear sections.
Figure 12:
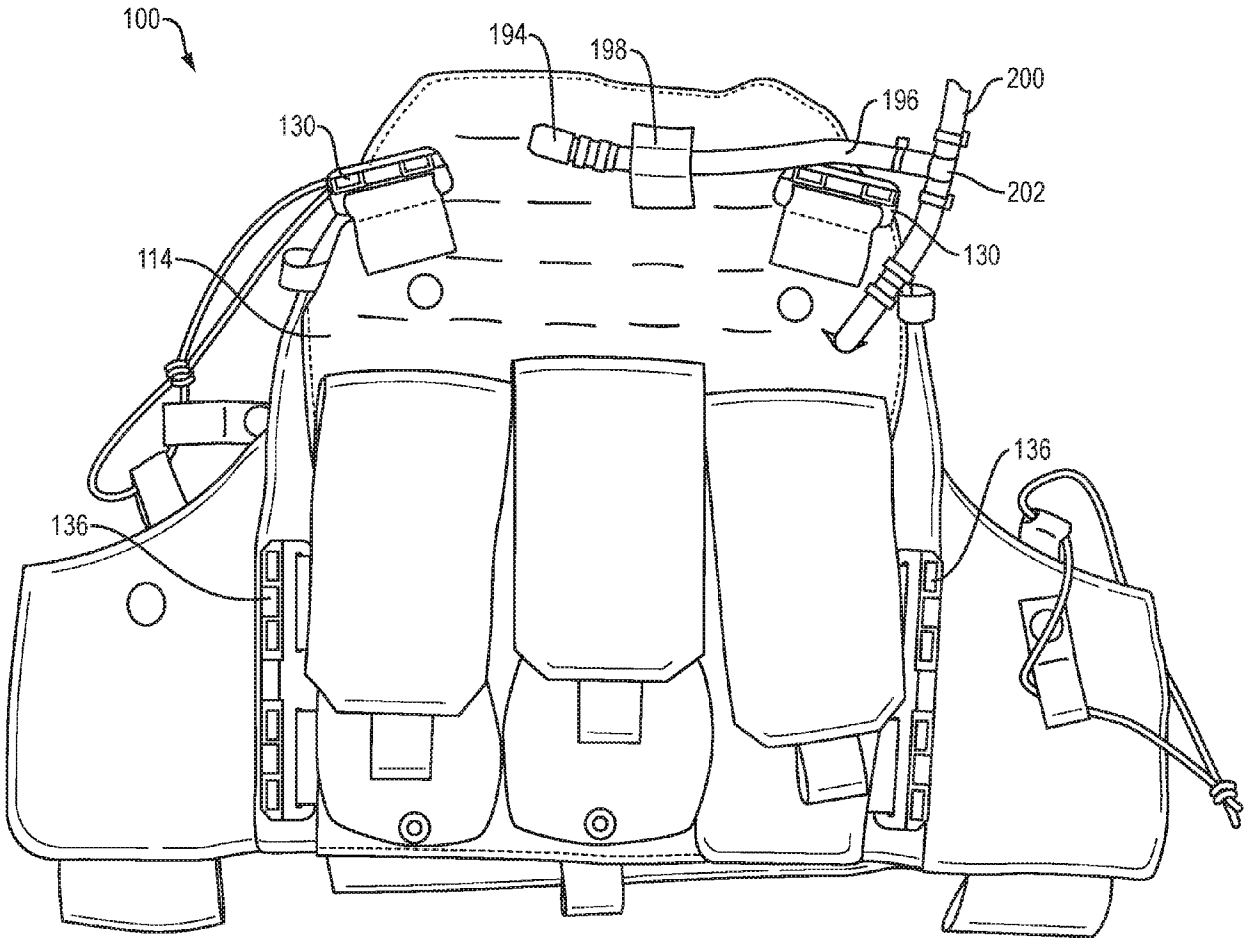
FIG. 12 is an enlarged view showing the exterior surface of the front section.
Figure 13:
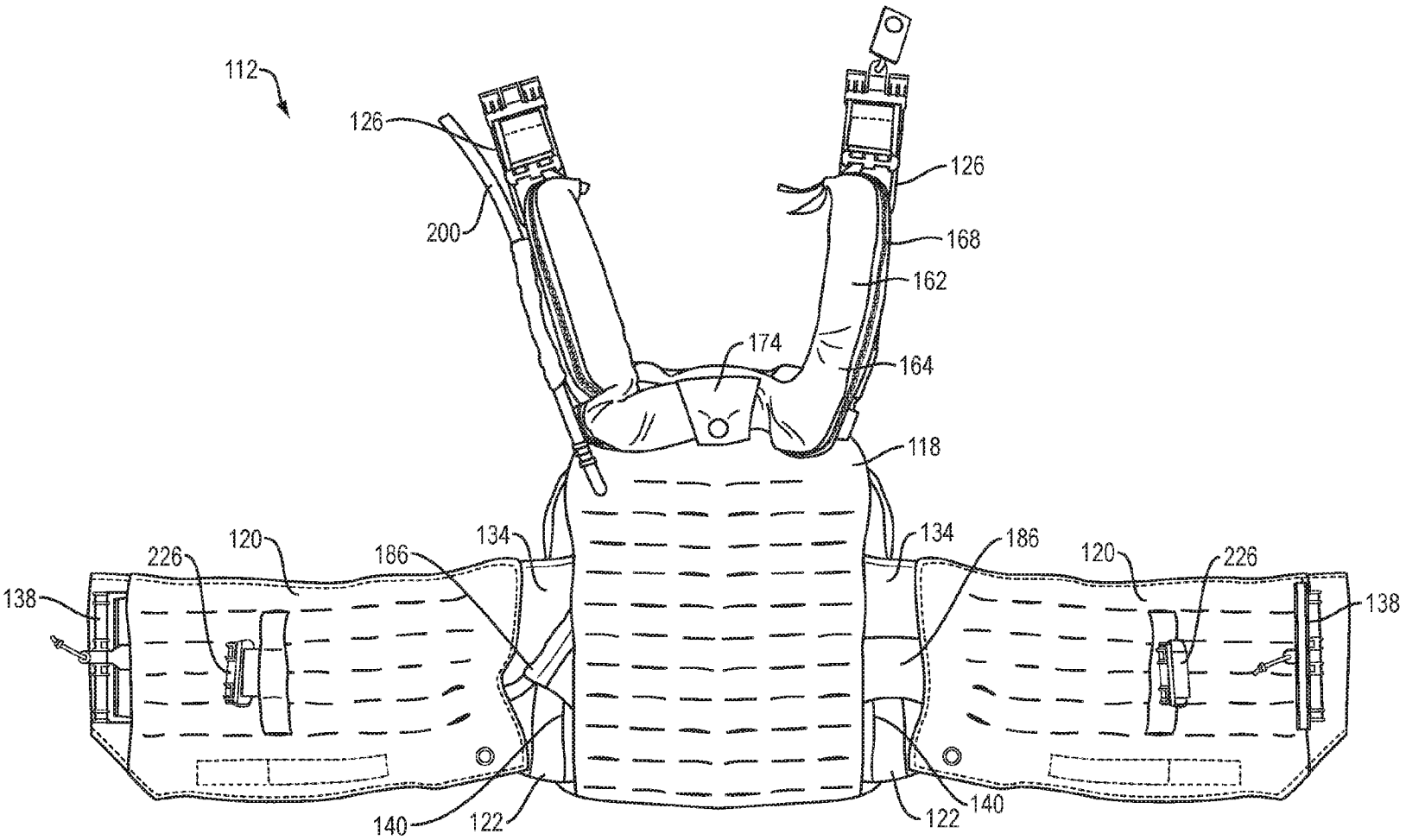
FIG. 13 is an enlarged view showing the exterior surface of the rear section.
Figure 14:
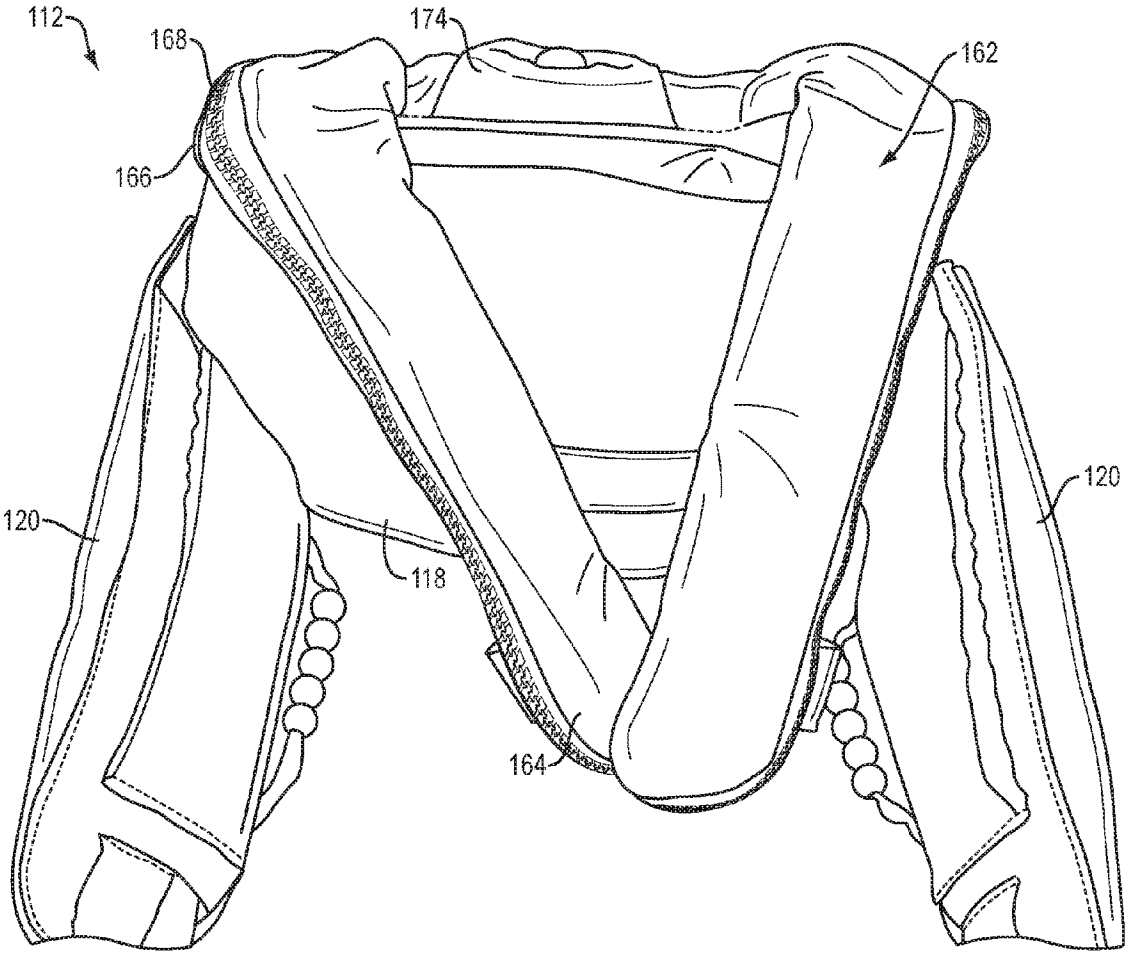
FIG. 14 is an enlarged view of the rear section showing the neck bladder compartment, taken generally from above and the front.
Figure 15:
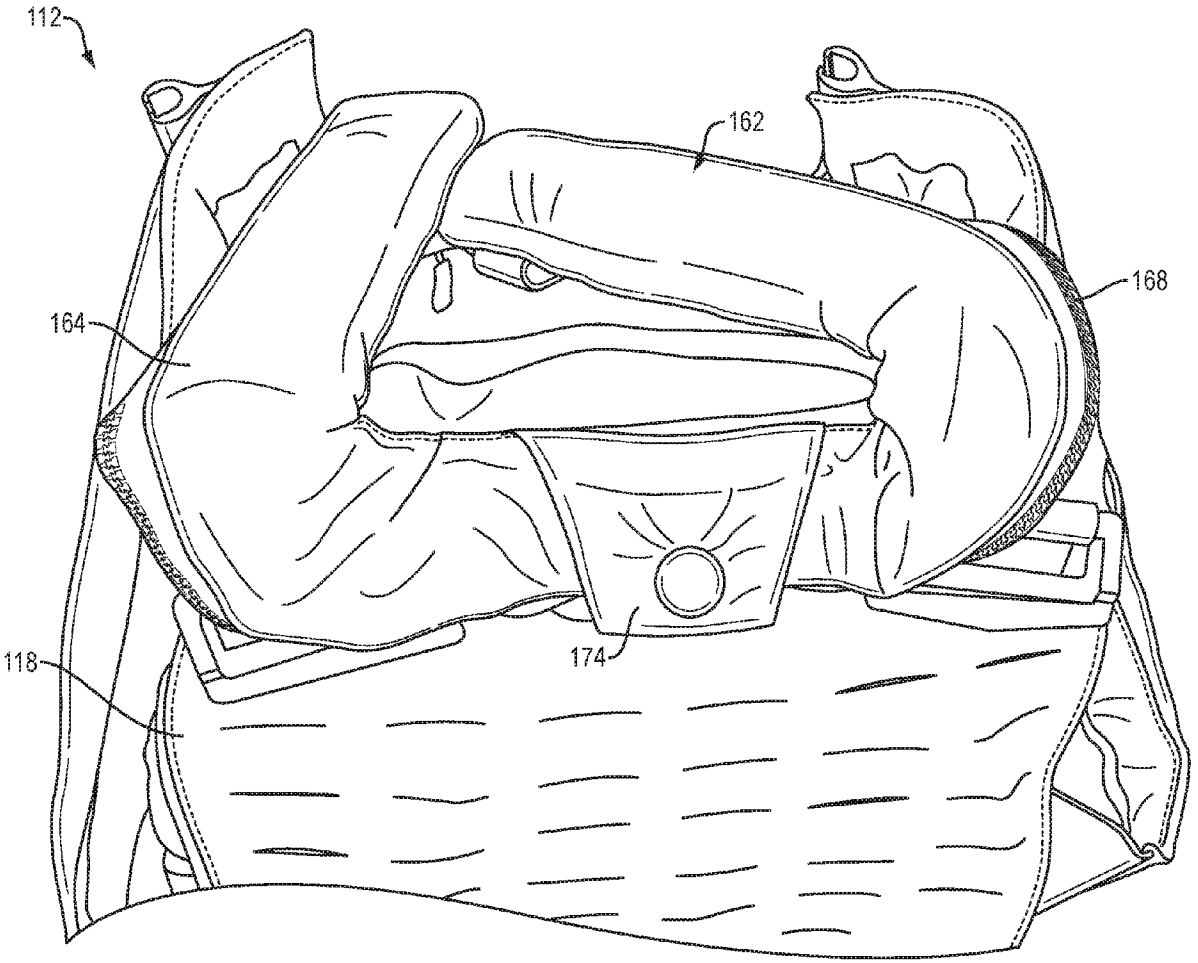
FIG. 15 is an enlarged view of the rear section showing the neck bladder compartment, taken generally from above and the rear.
Figure 16:
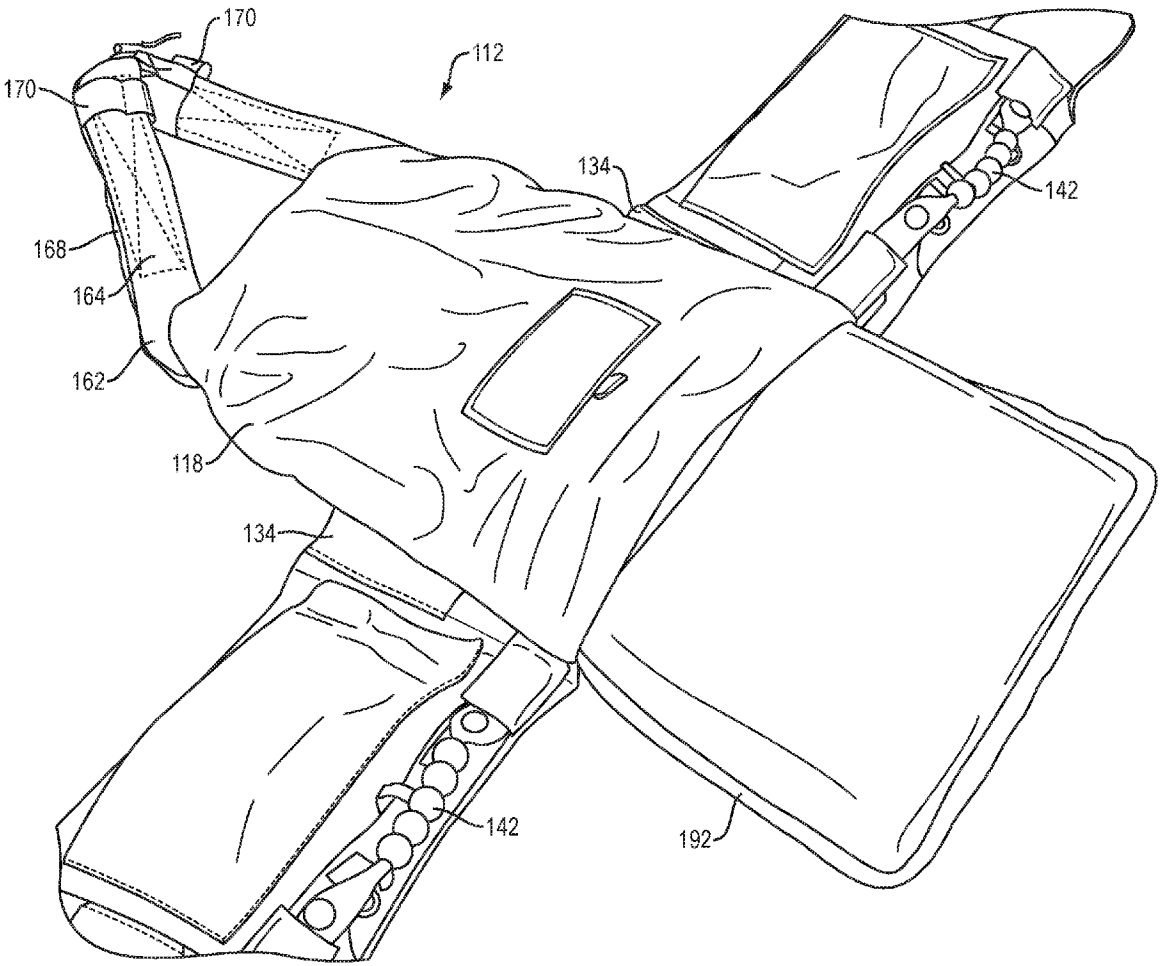
FIG. 16 illustrates an accessory panel partially inserted into the rear panel.
Figure 17:
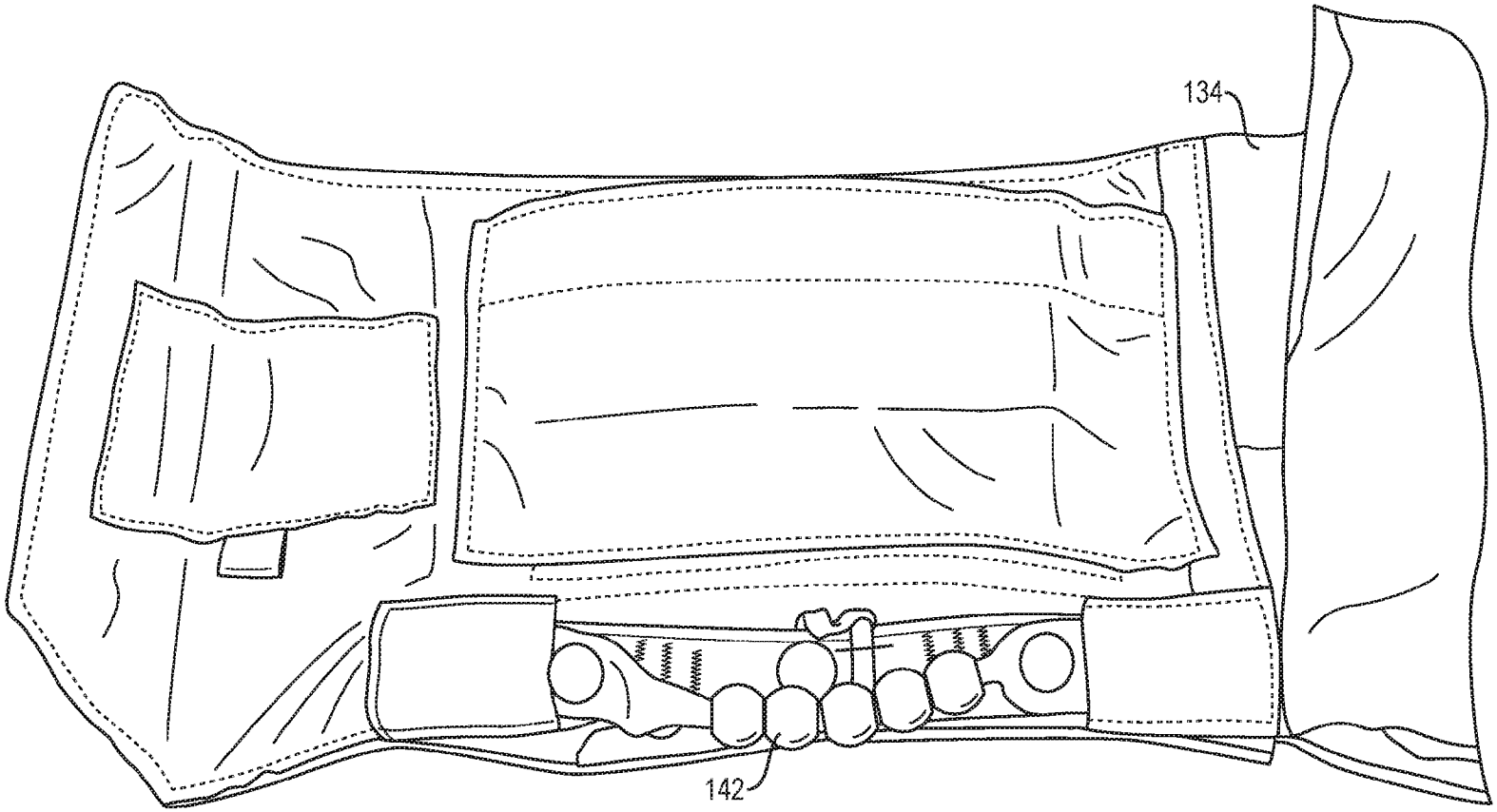
FIG. 17 is an enlarged view of the right side panel.
Figure 18:
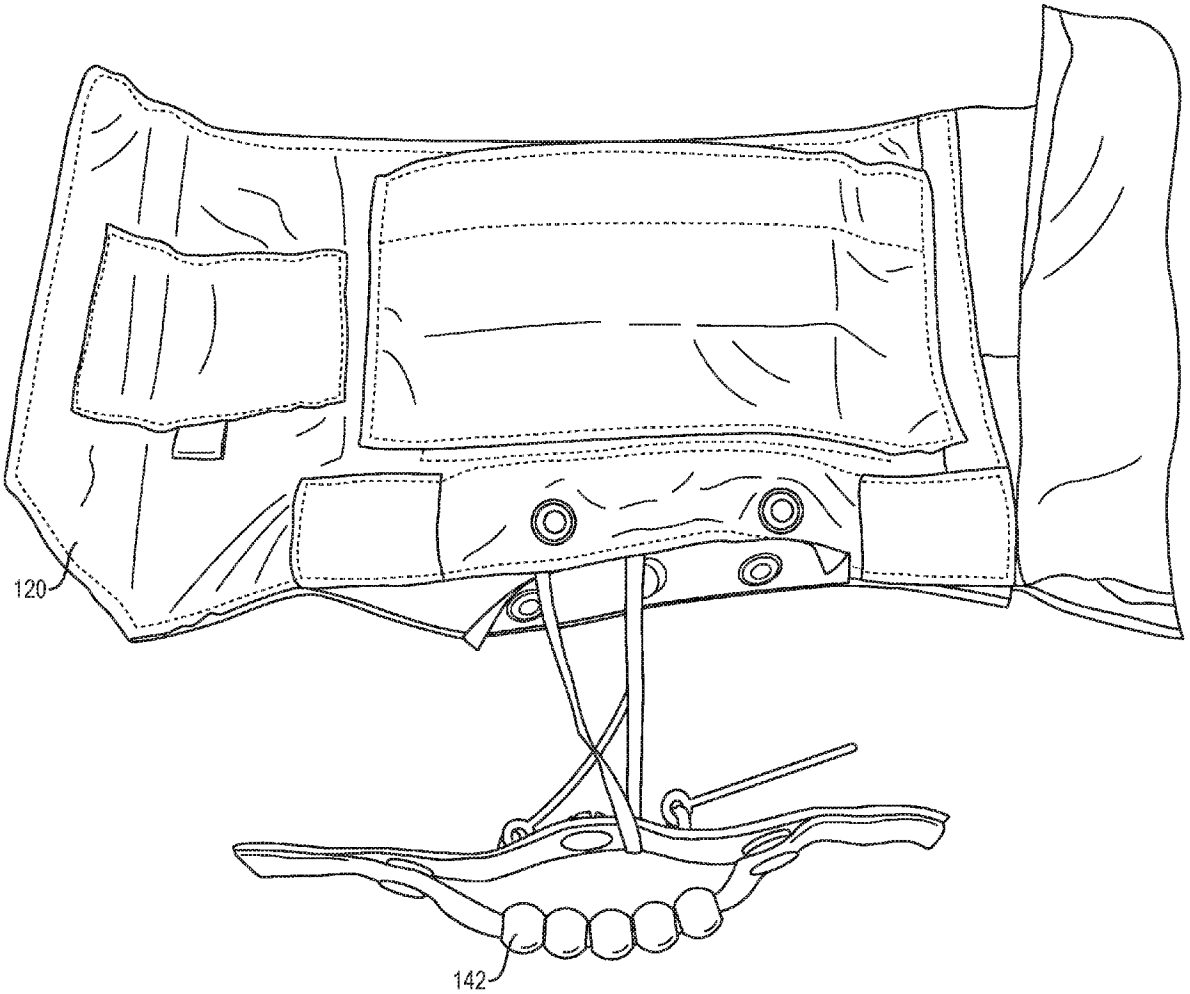
FIG. 18 shows the right side bladder actuator handle detached from the side panel.
Figure 19:
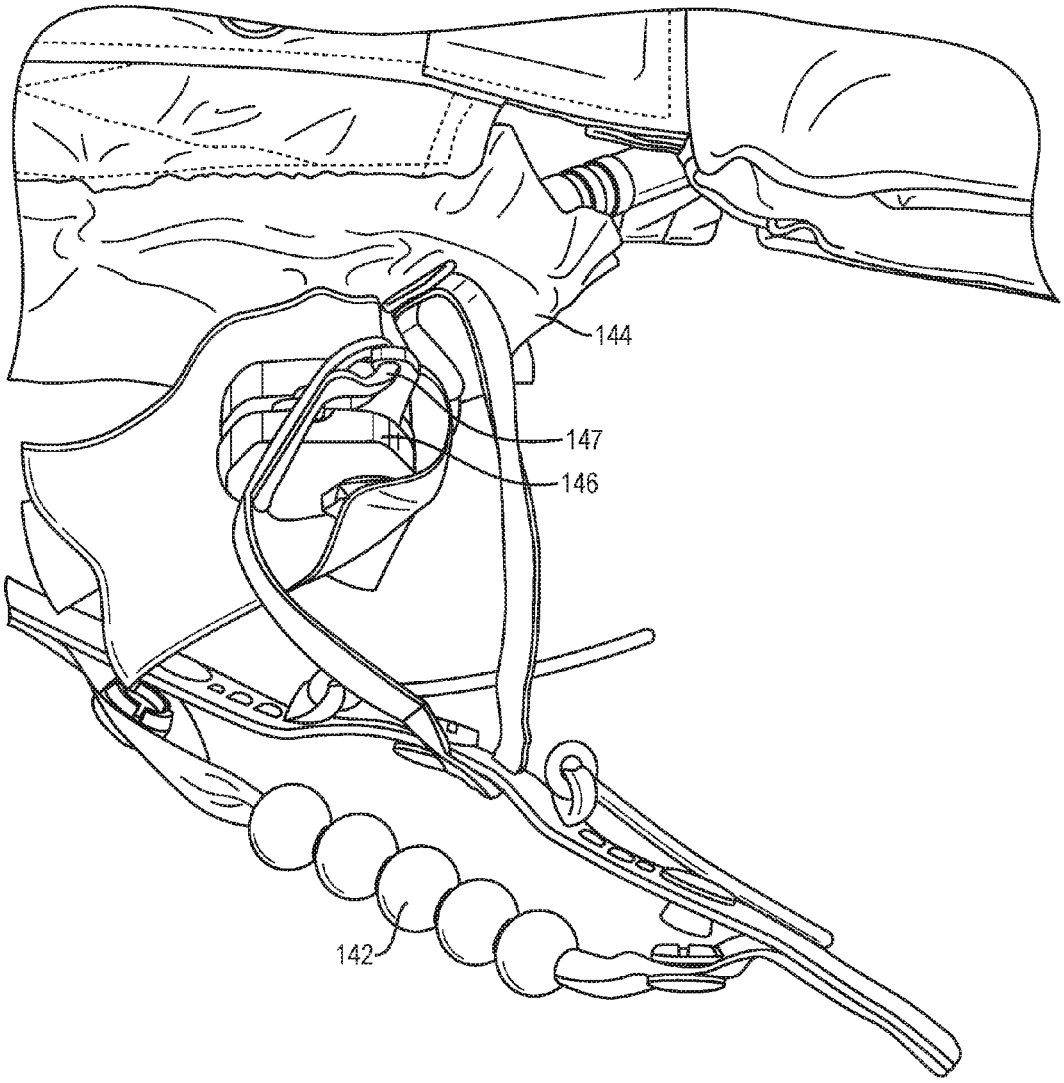
FIG. 19 shows the right side bladder partially removed and CO2 inflation valve.
Figure 20:
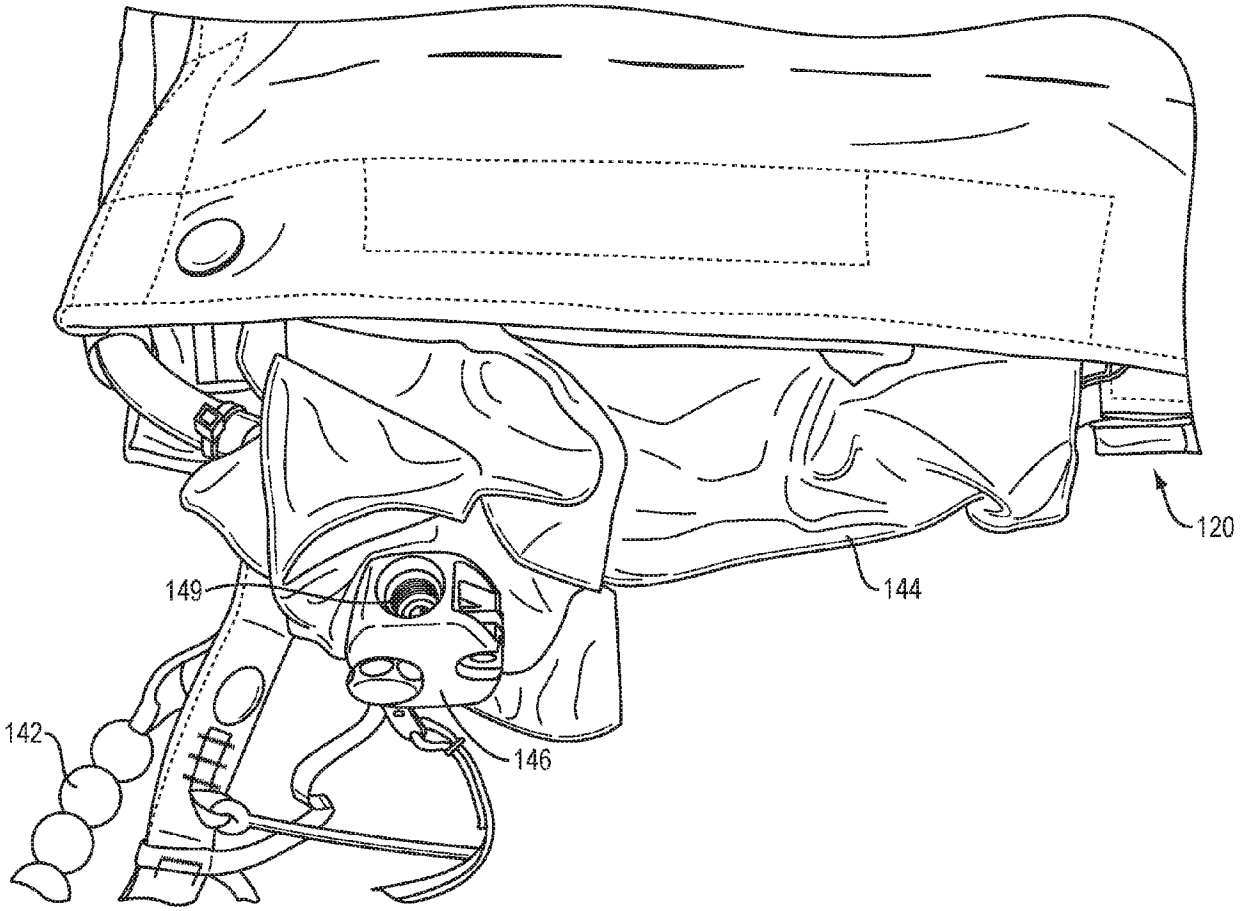
FIG. 20 shows the threaded connector for attaching a CO2 cartridge.
Figure 21:
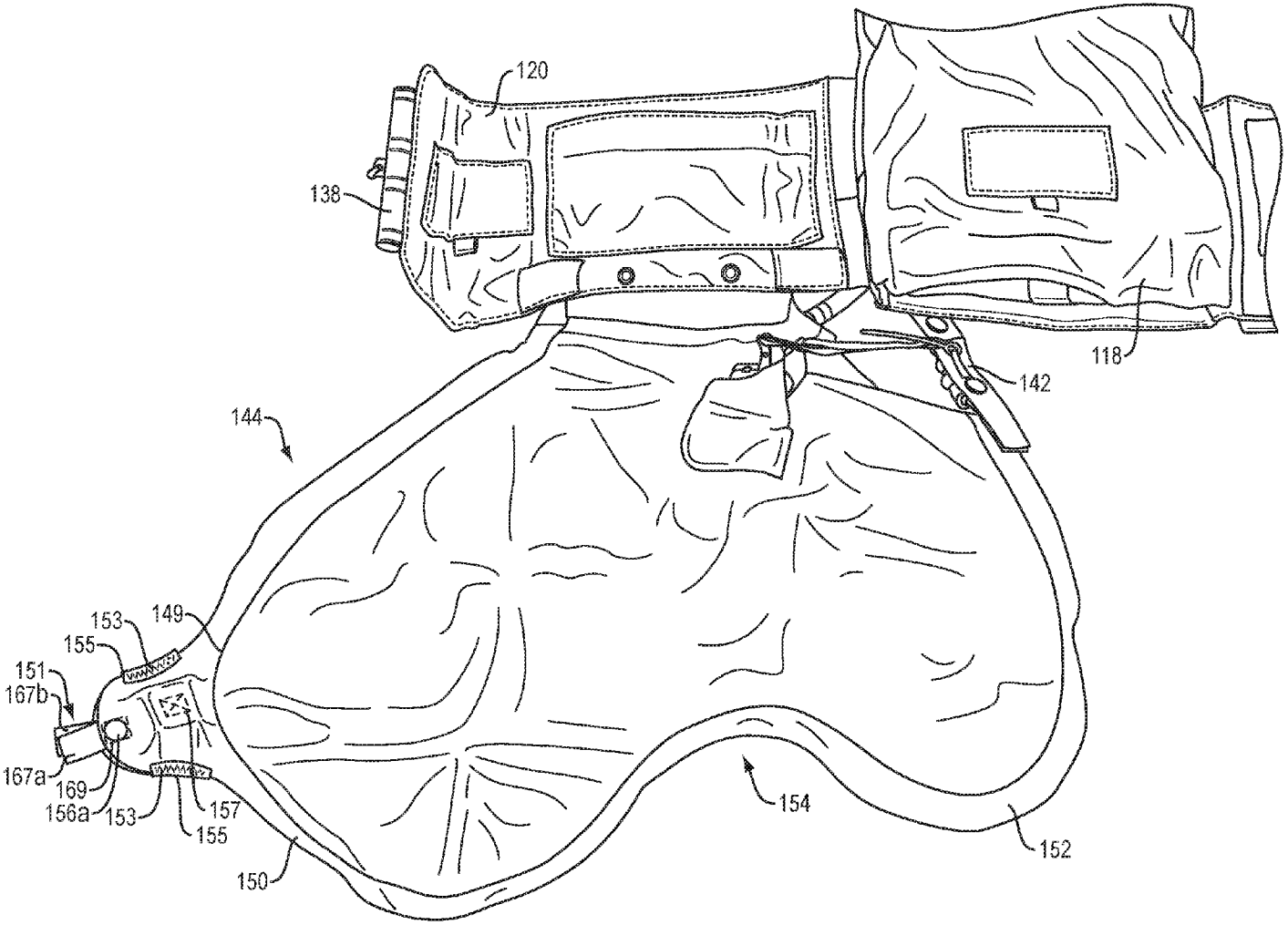
FIG. 21 shows the bottom/interior surface of the right side bladder removed from the right side panel in the uninflated condition.
Figure 22:
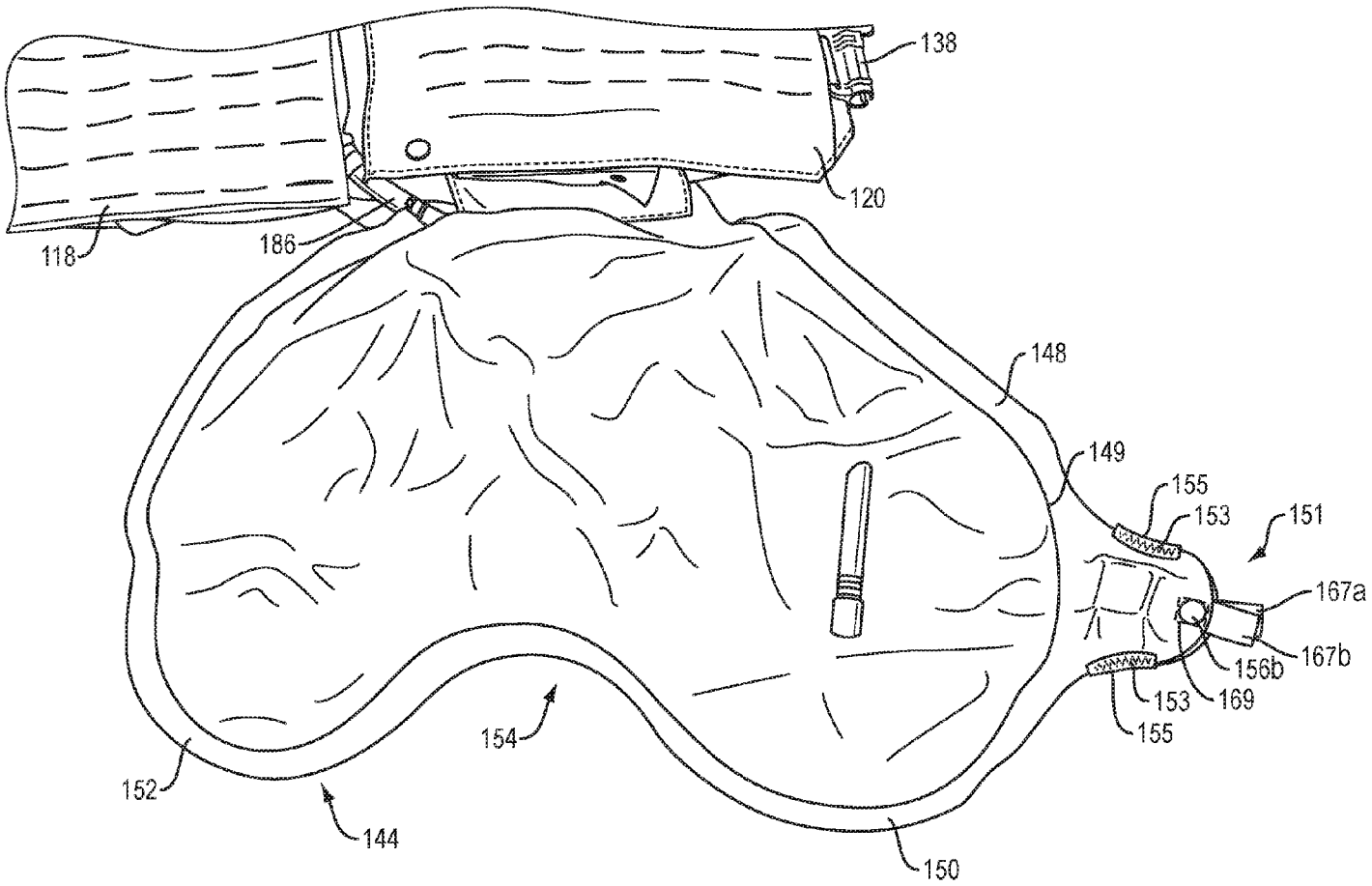
FIG. 22 shows the top/exterior surface of the right side bladder removed from the right side panel in the uninflated condition.

Referring now to the drawings an exemplary embodiment flotation vest 100 is shown, which may advantageously be configured as a tactical vest, ballistics plate carrier vest, or the like for military or law enforcement use in a marine or aquatic environment, although other configurations are also contemplated.

Figure 32:
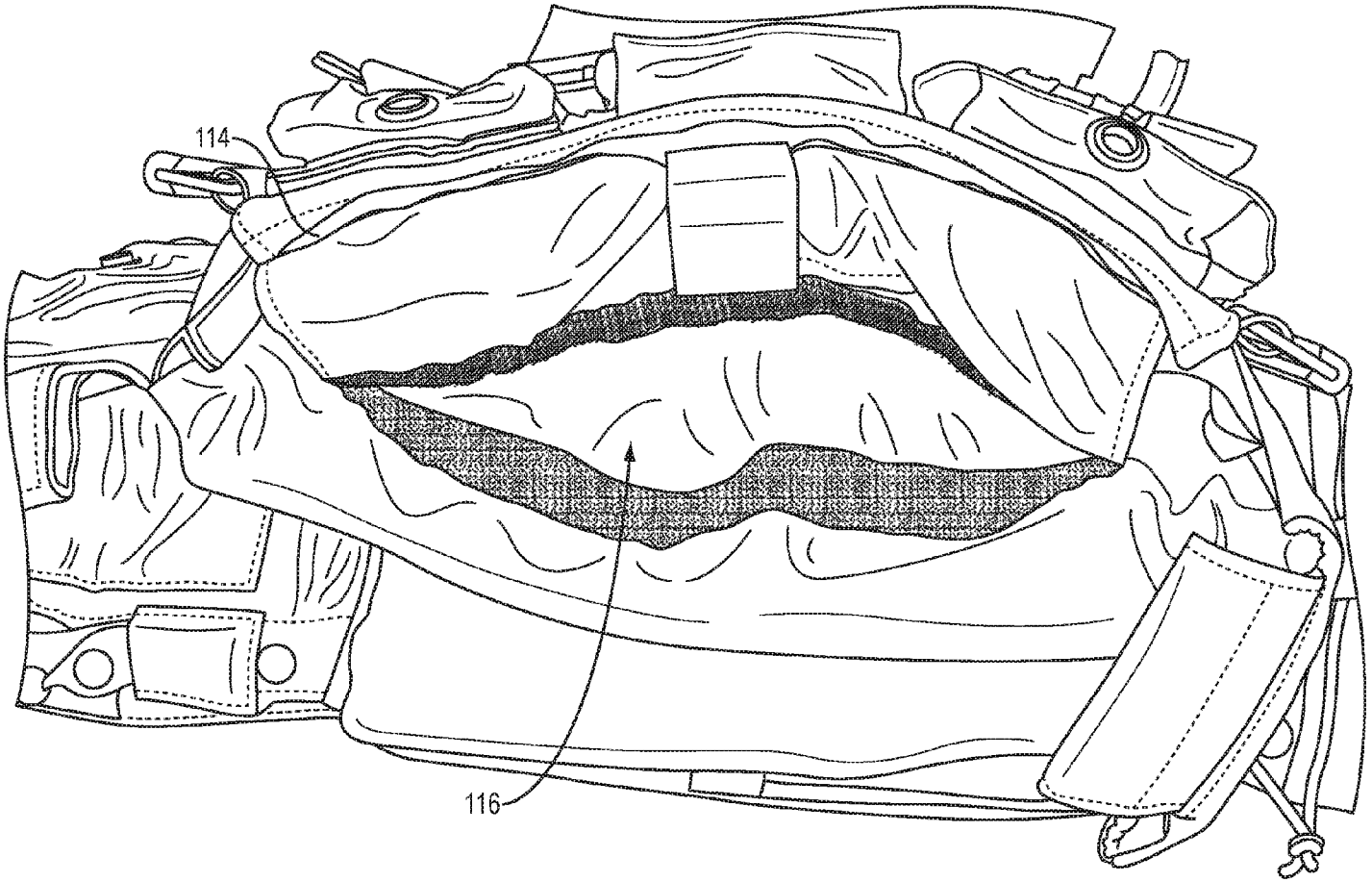
FIG. 32 illustrates the pocket opening for ballistics plate within the vest front panel.

The flotation vest 100 comprises a front section 110 removably attached to a rear section 112. The front section 110 comprises a front panel 114 adapted to be positioned on the user's front torso when worn. Advantageously, the front panel 114 includes one or more interior compartments 116 (see FIG. 32) for carrying one or ballistics plates and/or buoyancy compensators. In preferred embodiments, the front section includes two interior compartments, namely, a first compartment for receiving a ballistic plate, such as a hard or soft body armor plate, and a second compartment for receiving an inflatable buoyancy compensator, as will be described below. In especially preferred embodiments, the second compartment receiving the buoyancy compensator is positioned interiorly of the first compartment.

Figure 33:
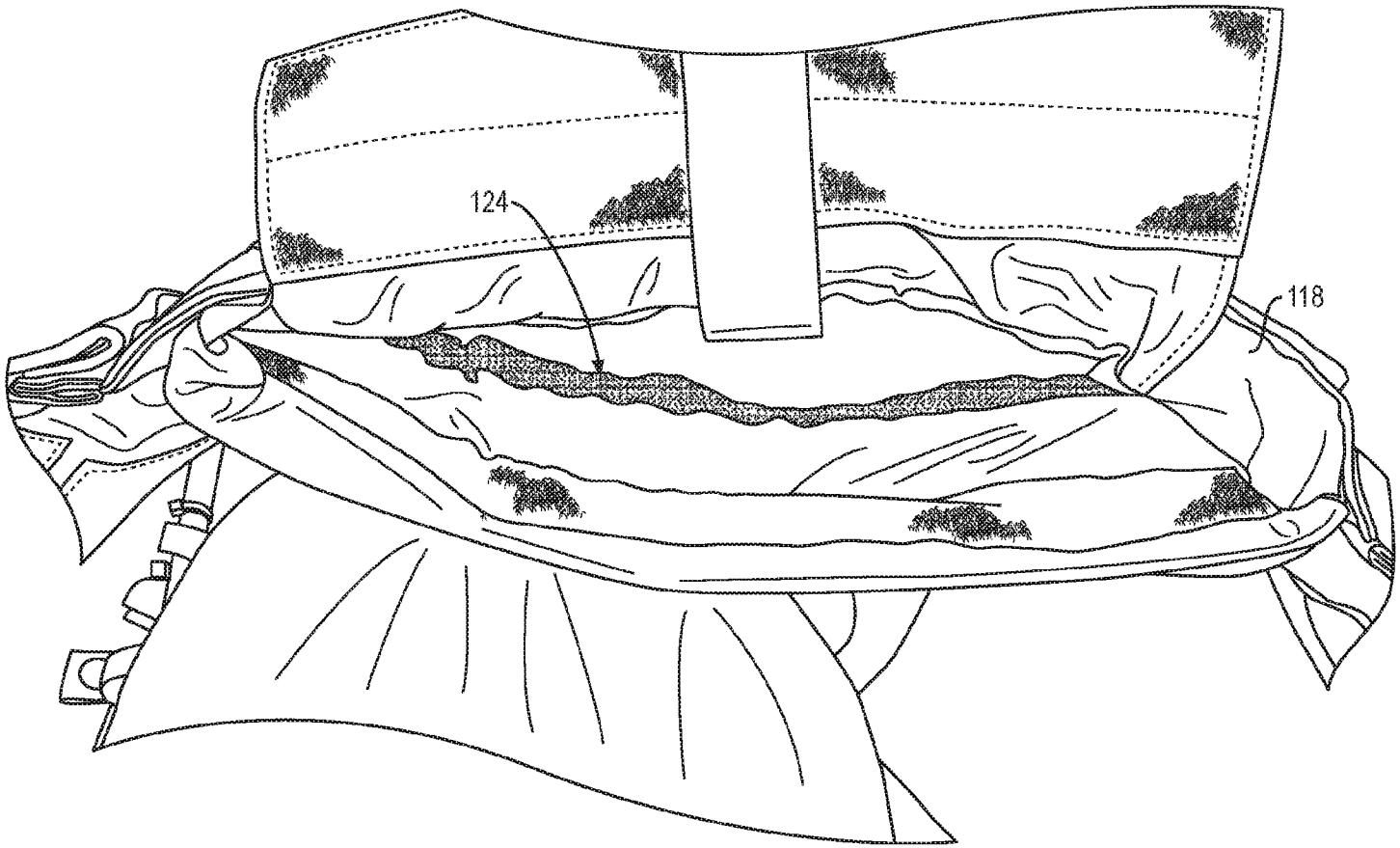
FIG. 33 illustrates the pocket opening for ballistics plate within the vest front panel.

The rear section 112 comprises a rear panel 118 adapted to be positioned on the user's back when worn, and left and right side panels or cummerbunds 120. The left and right side panels 120 are mirror images of each other. Advantageously, the rear panel includes one or more interior compartments 124 (see FIG. 33) for carrying one or ballistics plates and/or buoyancy compensators. In preferred embodiments, the rear section includes two interior compartments, namely, a first compartment for receiving a ballistic plate (e.g., a hard or soft body armor plate), and a second compartment for receiving an inflatable buoyancy compensator. In especially preferred embodiments, the second compartment receiving the buoyancy compensator is positioned interiorly of the first compartment.

A pair of shoulder straps 126 removably connects the front panel 114 to the rear panel 118. The shoulder straps are secured at their proximal end 128 to the rear panel 118, e.g., to a buckle 129 or the like on the rear panel 118.

The front panel 114 includes fastener elements 130 for removable attachment to complementary fastener elements 132 on the distal end of the shoulder straps 126. In the illustrated embodiment, the fastener elements 130, 132 are TUBES™ fasteners available from FirstSpear, LLC, of Fenton, Mo. It will be recognized that other types of fasteners including buckles, clips, snap fasteners, ties, hook and loop fasteners, and the like may also be used. The front panel may also include any number of fasteners, pockets, pouches, holsters, and so forth for carrying or attaching gear. The shoulder straps 126 are removed in FIGS. 14-16, 25, and 26 for ease of exposition.

The side panels 120 may further removably attach the front panel 114 to the rear panel 118. The side panels 120 are secured at their proximal ends 134 to opposing transverse sides the rear panel 118. The front panel 114 includes fastener elements 136 for removable attachment to complementary fastener elements 138 on the distal ends of the side panels 120. The proximal ends 134 of the side panels 120 may be permanently or removably secured to the rear panel 118, and in preferred embodiments can be adjusted to accommodate users of different sizes. In preferred embodiments, the side panels 120 include tabs 122 which extend into openings 140 in the rear panel 118 and are secured therein with a hook and loop fasteners or other mechanical fasteners.

In the illustrated embodiment, the fastener elements 136, 138 are TUBES™ fasteners available from FirstSpear, LLC, of Fenton, Mo. It will be recognized that other types of fasteners including buckles, clips, snap fasteners, ties, hook and loop fasteners and the like may also be used.

Each of the side panels may have an additional interior compartment for receiving ballistic slide plates (e.g., hard or soft body armor), ammunition or ammunition magazines, or other equipment. Each side panel 120 has a pull handle 142 for actuating an inflation bladder 144 located within an interior compartment within the side panel 120. The pull handle 142 is mechanically coupled to a valve 146, which in turn is coupled to a source of compressed gas 158, such as a CO2 cartridge as are generally known. The size of the gas cylinder should be selected to provide a desired degree of positive flotation without over inflation. In certain embodiments, the inflatable bladders are sized to receive gas from two 38 gram CO2 cartridges. In certain embodiments, a one way check valve may be fluidically coupled to the inflatable bladders to release gas when the pressure exceeds a certain threshold to prevent overinflation and possible rupture of the bladders.

A threaded connector 149 is provided for removably attaching a CO2 cartridge or like source of a compressed gas 145. When the pull handle 142 is tugged, the valve 146 is actuated, e.g., via an actuator lever mechanically coupled to the handle 142, to allow compressed gas to flow into and inflate the bladder 144. When the pull handle 142 is tugged, the bladder 144 is partially removed from the interior compartment of the side panel 120, such that inflation of the bladder causes the bladder to exit the compartment.

In additional to, or as an alternative to, the mechanical valve actuator 147, a chemical and/or electronic actuator for inflating the bladder 144 is also contemplated. A chemical actuator may employ a spring biased firing pin separated from the source of compressed gas by a water soluble pill or bobbin wherein the pill or bobbin will dissolve in the presence of water allowing the firing pin to pierce the source of compressed gas to inflate the bladder 144. An electronic actuator may include a switch having spaced-apart electrodes or contacts which are triggered when water bridges the contacts or any other electronic actuator which senses water.

If the bladder 144 fails to inflate or if the user has not installed properly weighted CO2 cartridges, the user may manually inflate the inflation bladder 144 using an oral inflation valve 148. In the depicted preferred embodiment, the oral inflation valve 148 is located on the front lobe so as to be positioned near the user's mouth when the unit is donned by the user.

In the illustrated preferred embodiment, the bladder 144 is generally kidney shaped, including a front lobe 150 and a rear lobe 152, defining a cutaway portion 154 providing a space for the user's arm during operation. In the depicted preferred embodiment, the front lobe is larger than the rear lobe to assist in orienting a user to a generally face up and reclined position in the water. In the preferred embodiments, each of the front lobes has a fastener element thereon to allow the left and right bladders 144 to be removably attached together in front of the user's body. In addition, providing fastener elements on the bladders 144 also allow two or more divers wearing the system to be hooked together via the fastener elements, e.g., to allow two or more divers to tether themselves together in an emergency situation. For example, such fastener elements could be used by a first diver to attach to a second diver such as a diver that is unconscious or otherwise requiring aid. In this manner, the first diver can render aid to the second diver while preventing separation or otherwise reducing the risk of separation.

In certain embodiments, not shown, the fastener elements on the front lobes 150 of the left and right bladders 144 may be quick release fasteners, such as complementary snap fasteners or complementary side release fasteners. In the illustrated preferred embodiment, each of the side bladders 144 includes a pocket region 151 defined between the two plies of material forming the bladder 144.

Figure 23:
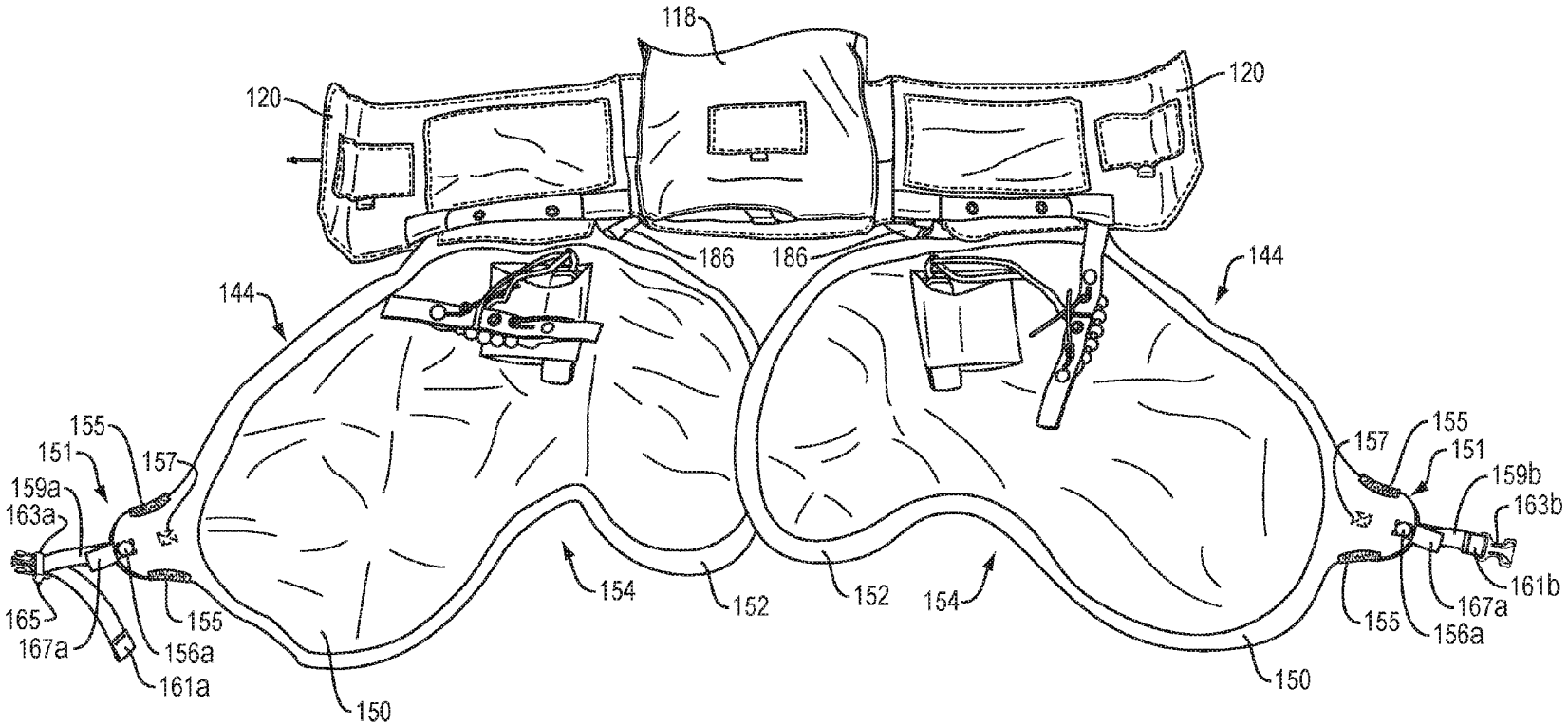
FIG. 23 shows the bottom/interior surface of the left and right side bladders removed from the respective side panels in the uninflated condition.
Figure 24:
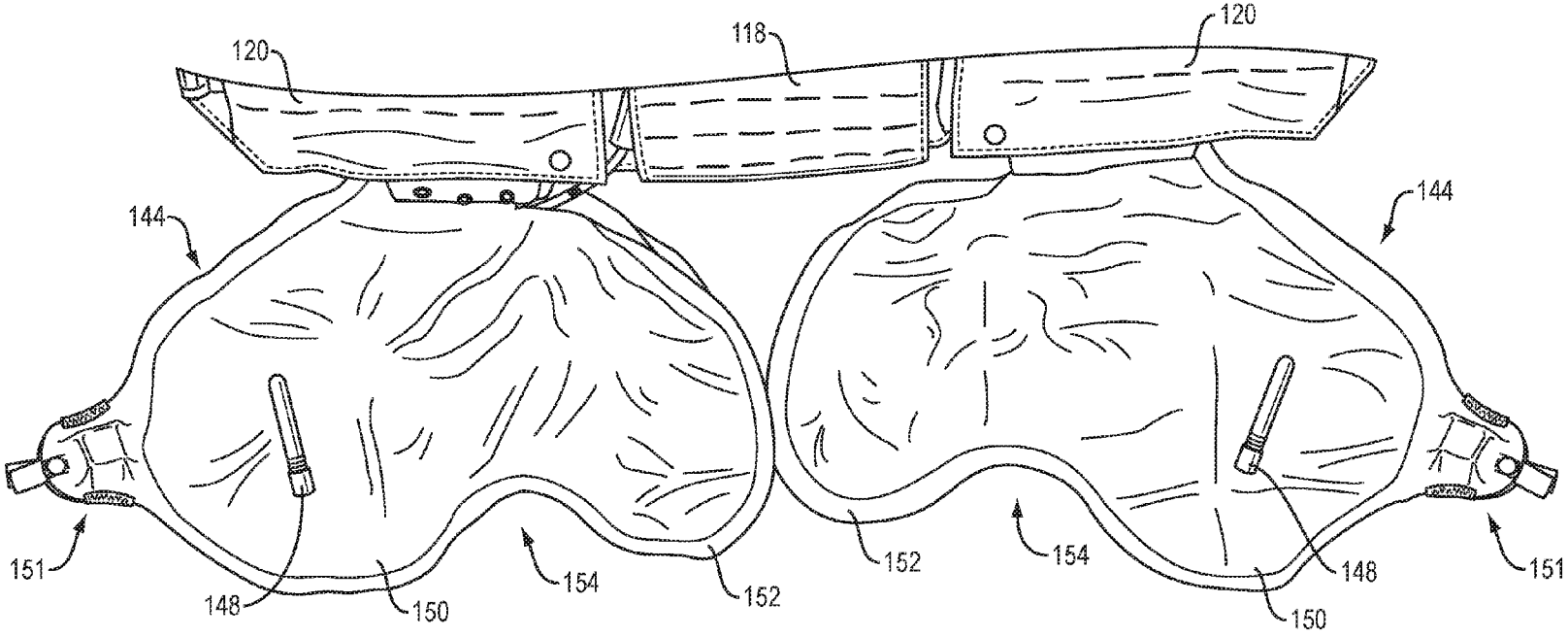
FIG. 24 shows the top/exterior surface of the left and right side bladders removed from the respective side panels in the uninflated condition.
Figure 25:
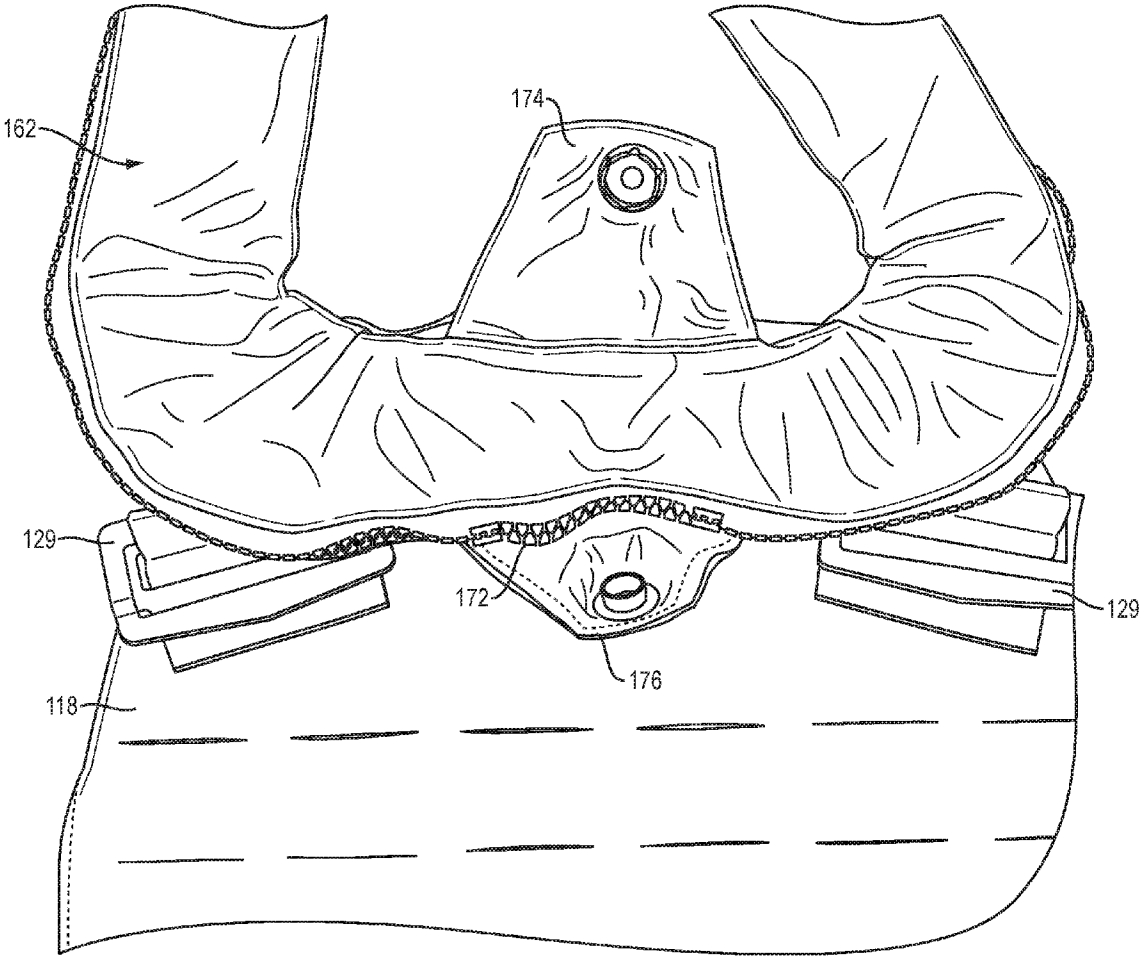
FIG. 25 shows the snap tabs and vulnerable portion of the zipper fastener securing the neck bladder compartment.
Figure 26:
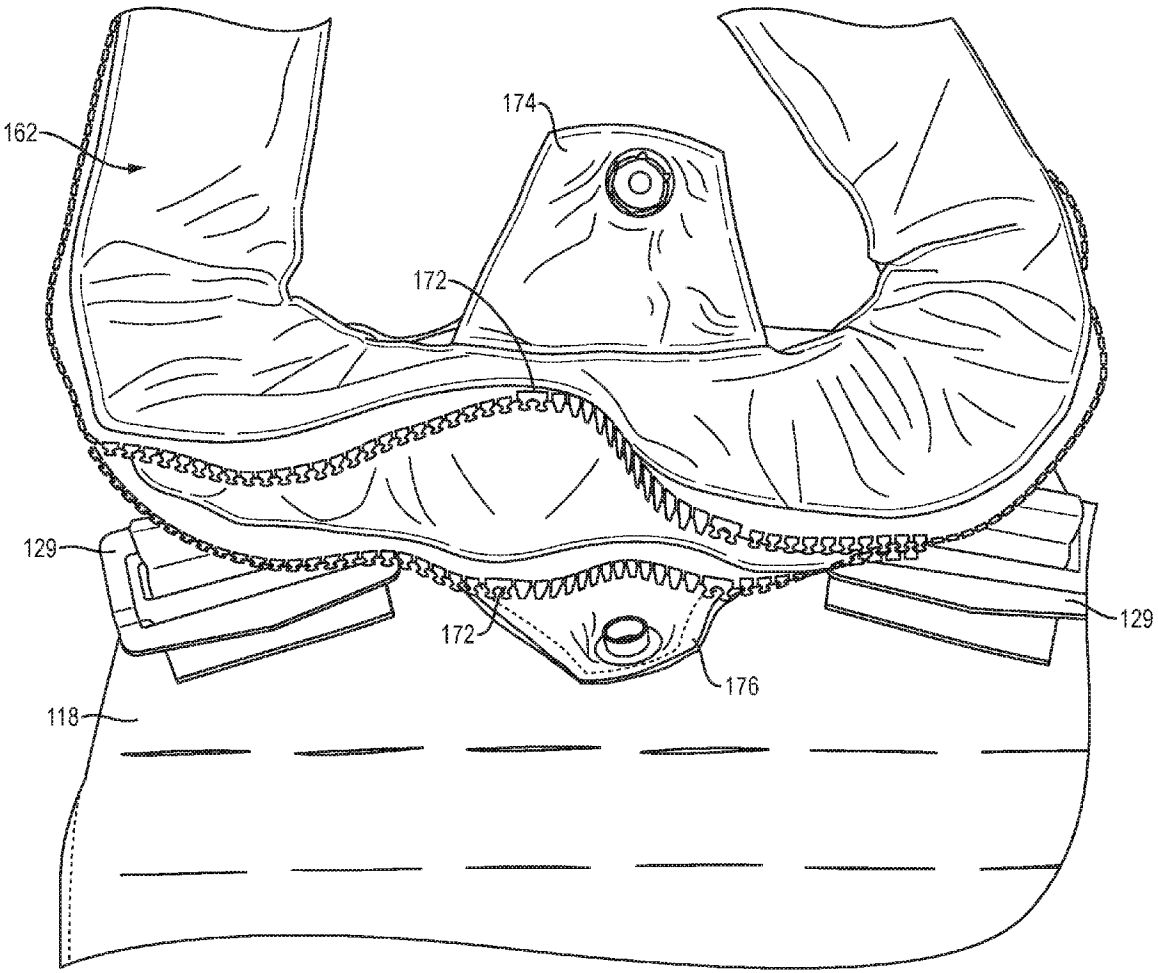
FIG. 26 shows the zipper fastener securing the neck bladder compartment in a partially unzipped state as a result of a separating force.
Figure 27:
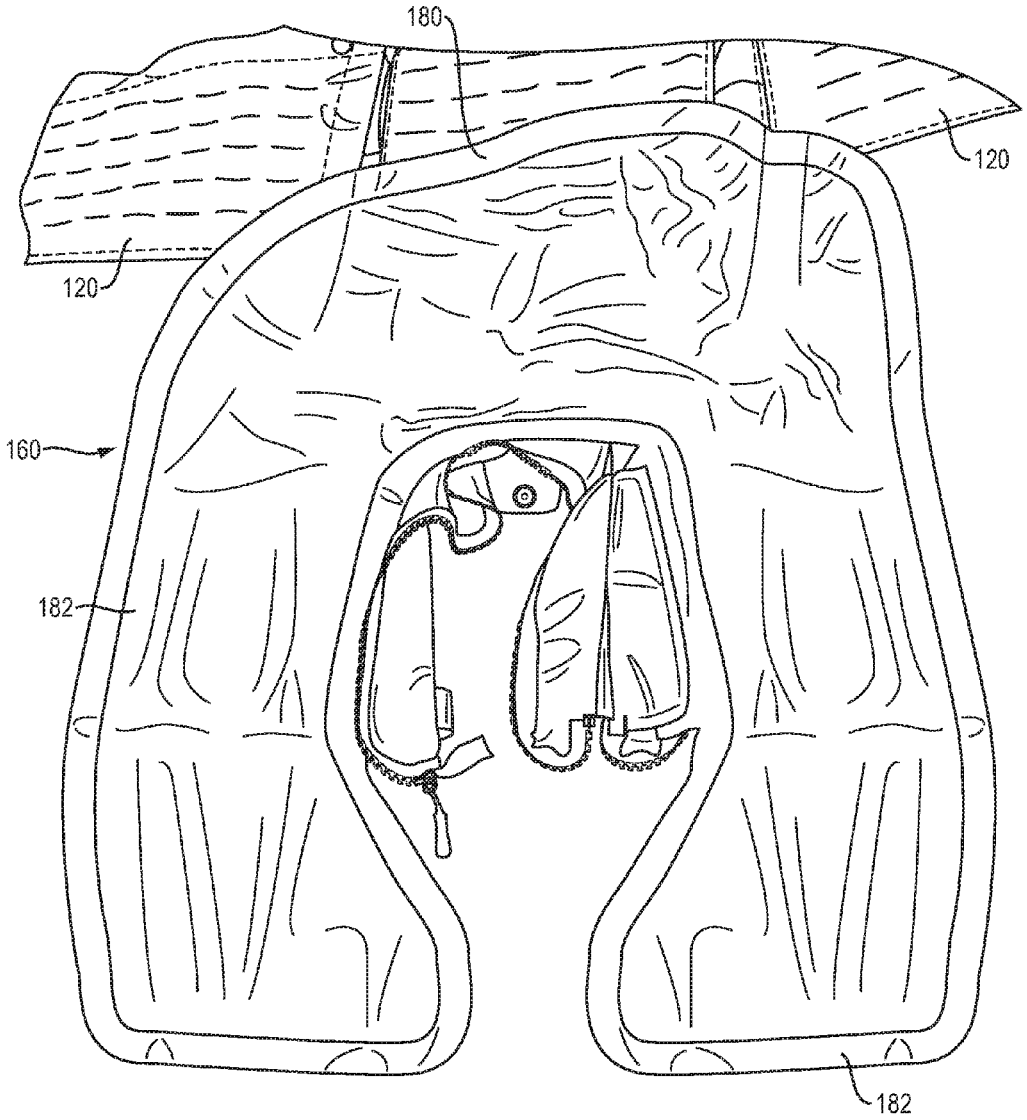
FIG. 27 shows the neck bladder unzipped and neck bladder removed in the uninflated state.
Figure 28:
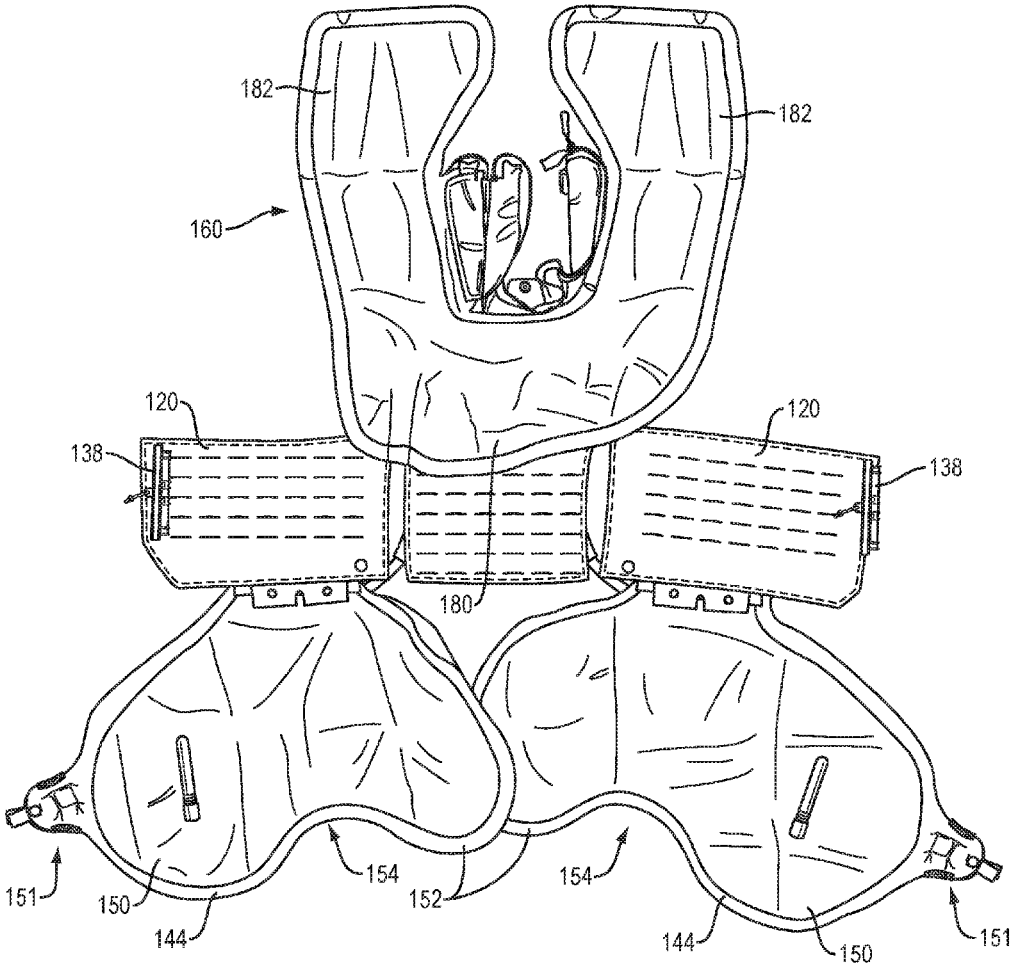
FIG. 28 illustrates the rear section with the left and right side bladders and neck bladder removed in the uninflated condition.
Figure 29:
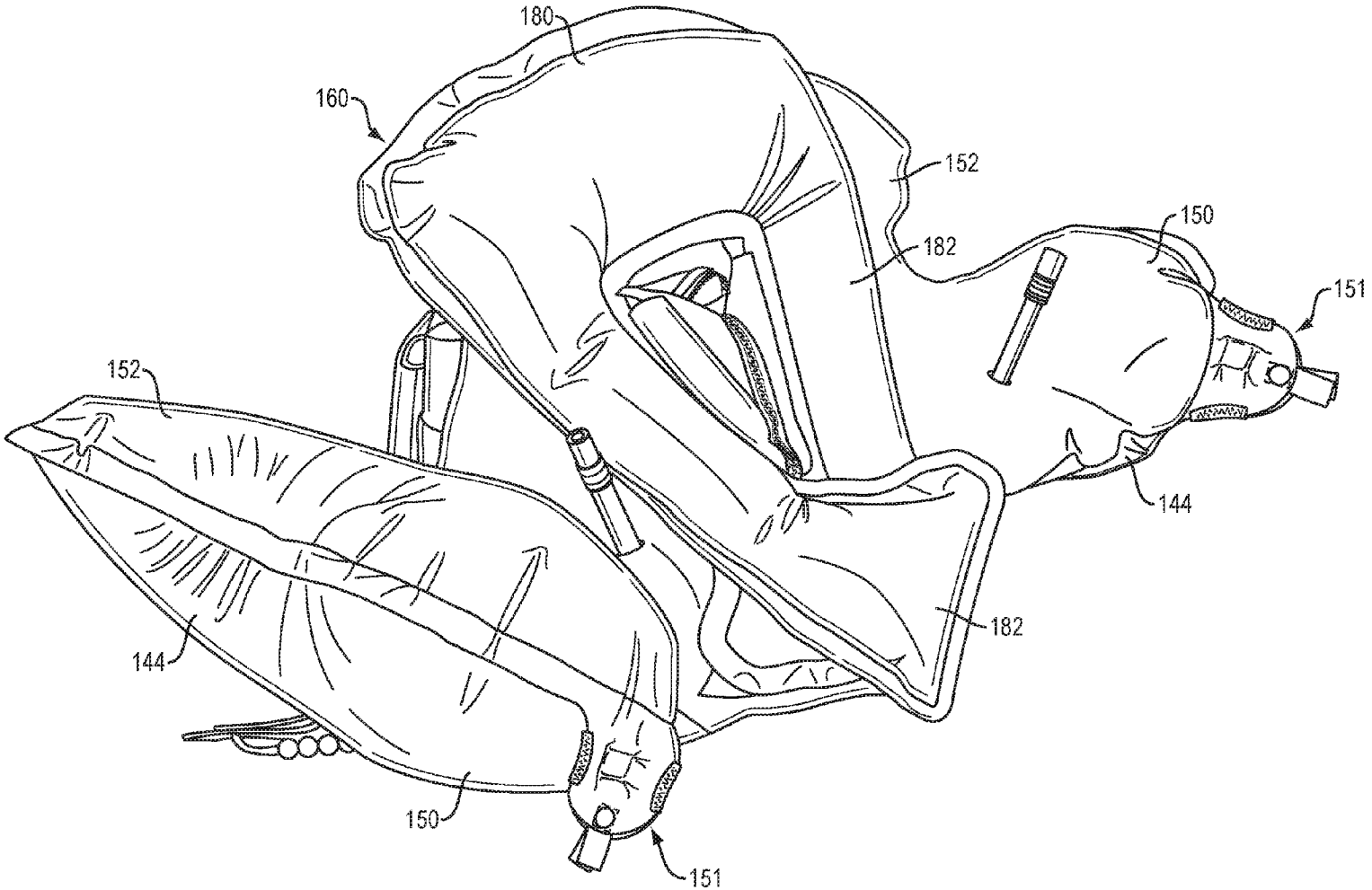
FIG. 29 is a perspective view of the rear section with the left and right side bladders and neck bladder inflated.
Figure 30:
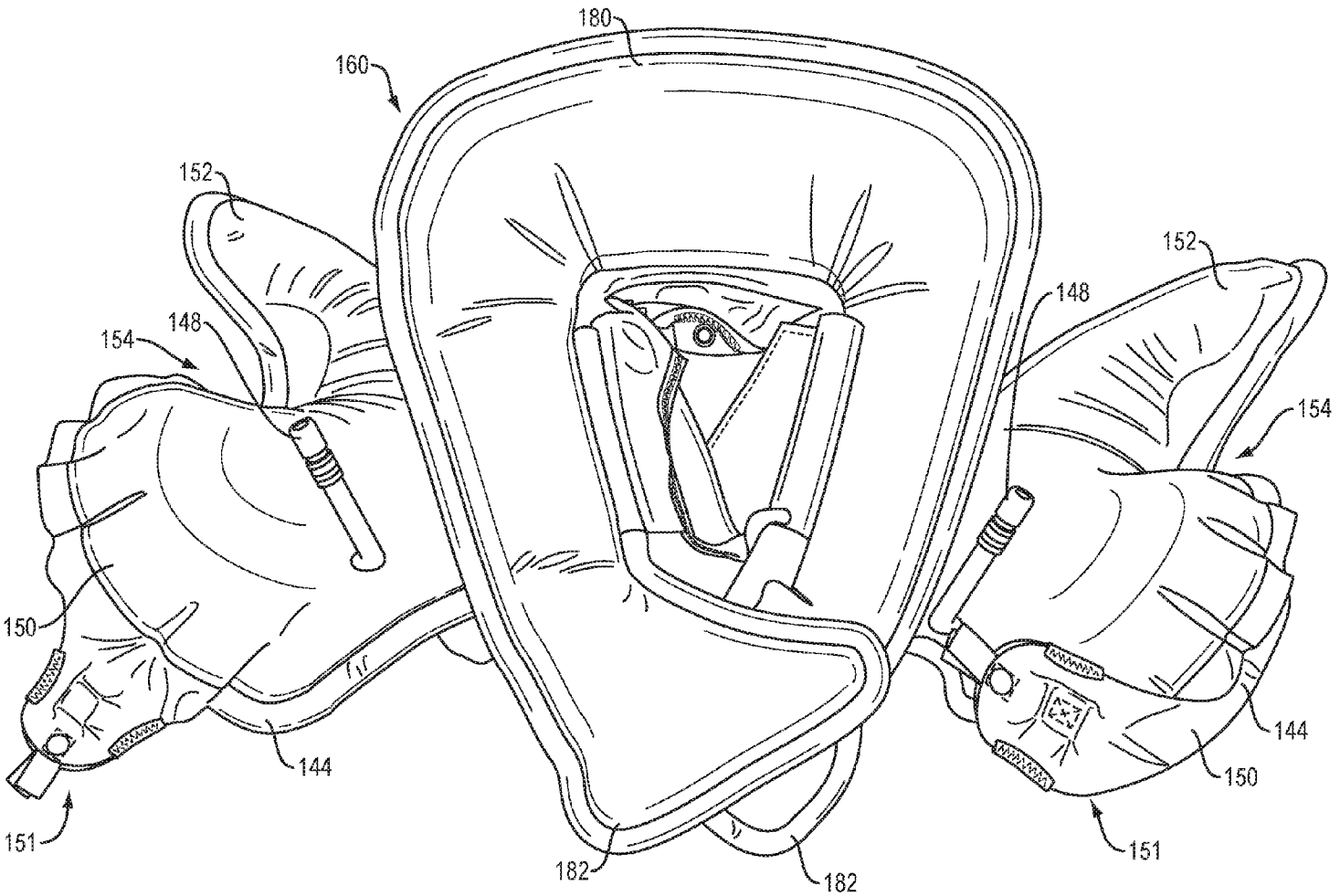
FIG. 30 is a front view of the rear section with the left and right side bladders and the neck bladder inflated.
Figure 31:
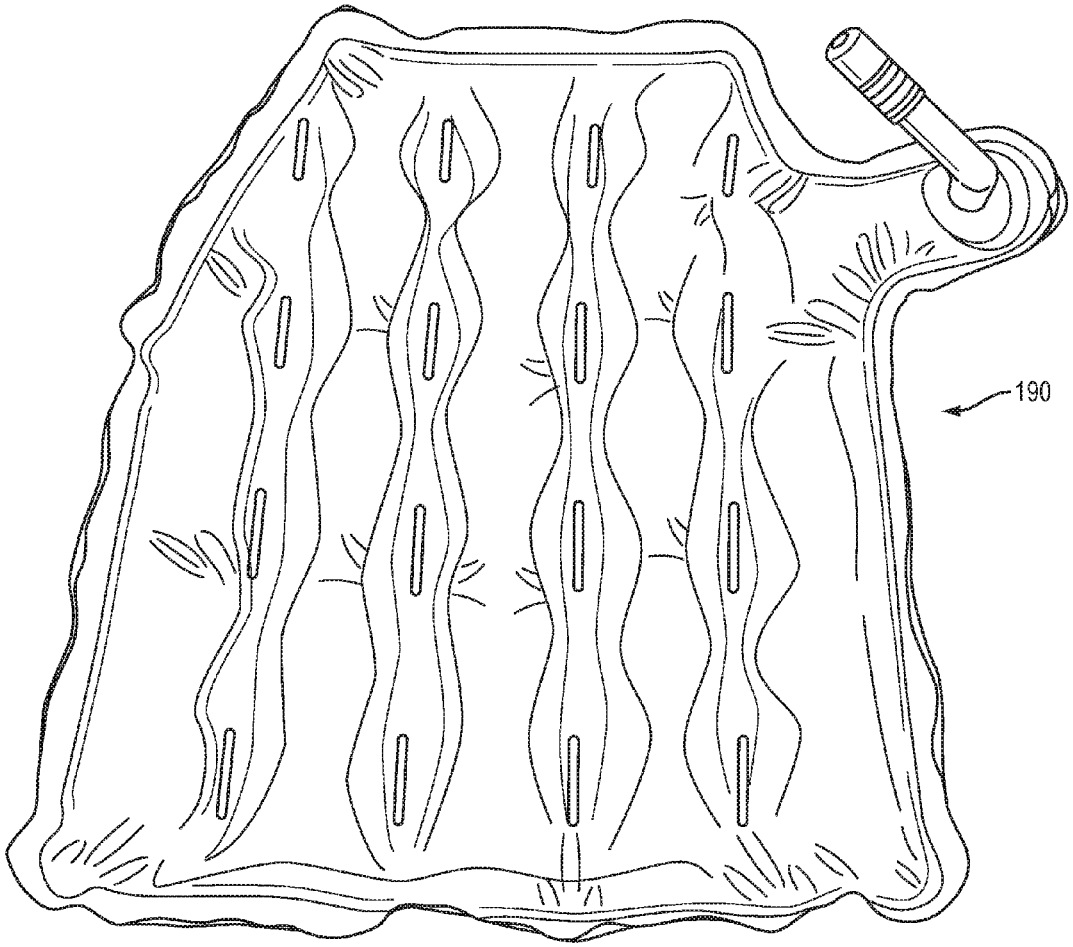
FIG. 31 depicts an exemplary inflatable ballistic plate for insertion into the front or rear panel.

As best seen in FIG. 23, the pocket 151 is defined by the two flaps of material forming the bladder 144 and is closed on the proximal end via the permanent bond 149 between the bladder ply layers. The pocket 151 is closed on opposite transverse sides by closures 153. The closures 153 may be stitching and are preferably include fabric tape 155 secured over the unfinished edge of the bladder ply material to provide reinforcement, which it when secured by the stitching 153. Alternatively, the side closures may be formed using an adhesive or by thermally bonding or fusing the edges of the bladder plies together.

The pocket 151 this defines an open distal end which is releasably closed via a releasable fastener such as complementary male and female snap fasteners 156*a* and 156*b*. Other releasable fasteners may also be employed in place of the snap fasteners, such as hook and loop fasteners.

The pocket 151 on the right bladder 144 receives a strap 159*a* having a first end sewn into the pocket 151, e.g., via stitching 157, or otherwise permanently secured within the pocket 151. The strap 159*a* includes a second end 161*a* opposite the first end. A first fastener element 163*a* is received on the strap 159*a*. In the illustrated embodiment, the first fastener element 163*a* is a side release type fastener having an integral emergency whistle 165 as are generally commercially available. The first fastener element 163*a* is slidably received on the strap 159*a* and may be fixed at a desired position along the length of the strap 159*a*.

A first pull tab 167*a* is attached to one of the plies defining the bladder 144 and a second pull tab 167*b* is attached to the other one of the plies, e.g., by stitching 169. The tabs 167*a*, 167*b* assist the user in separating the snap fastener elements 156*a*, 156*b* and additionally reinforce their attachment to the bladder 144.

The pocket 151 on the left bladder 144 receives a strap 159*b* having a first end sewn into the pocket 151, e.g., via stitching 157, or otherwise permanently secured within the pocket 151. The strap 159*b* includes a second end 161*b* opposite the first end. A second fastener element 163*b* is received on the strap 159*b*. In the illustrated embodiment, the second fastener element 163*b* is a side release type fastener complementary with the first fastener element 163*a*. The second fastener element 163*b* is affixed to the end 161*b* of the strap 159*b*.

A first pull tab 167*a* is attached to one of the plies defining the bladder 144 and a second pull tab 167*b* is attached to the other one of the plies, e.g., by stitching 169. The tabs 167*a*, 167*b* assist the user in separating the snap fastener elements 156*a*, 156*b* and additionally reinforce their attachment to the bladder 144.

The tabs 167*a*, 167*b* and the straps 159*a*, 159*b* may advantageously be formed of a nylon web material or other suitable strap material. The straps 159*a*, 159*b* and respective fastener elements 163*a*, 163*b* are folded and inserted into the respective one of the pockets 151 and are retained therein by securing the fasteners 156*a*, 156*b* together.

In the illustrated preferred embodiment, the bladders are formed from two layers of water and gas impermeable sheet material, secured about the periphery via the bond 149 to define an inflatable chamber. The shape of the sheet materials is advantageously selected to provide a desired three-dimensional shape or structure of the bladder when inflated. The sheet material may be fabric, plastic coated fabric, nylon, polymer sheet material, and so forth.

A neck or head support bladder 160 is provided on the rear panel 118 and is positioned behind the user's head. The bladder 160 when uninflated is folded or rolled up and stored within a generally U-shaped zippered compartment 162. The zippered compartment includes an upper fabric shell 164 and a lower fabric shell 166 secured in the closed position with a zipper 168. The shoulder straps 126 can be fed through loops 170 formed on the lower shell 166 to secure the compartment 162 to the shoulder straps 126.

The zipper 168 includes a noninterlocked portion 172 where the zipper teeth are non-interlocking. The noninterlocked portion 172 allows the zipper 168 to separate and continue separating even along the interlocked portion with a relatively low separating force. In this manner an inflation force will cause the zipper 168 to separate when the bladder 160 is inflated. Snap tabs 174 and 176 are snapped together about the noninterlocked portion 172. The snap tabs are configured to separate upon exertion of an inflation pressure. However, the snap tabs have a greater separation resistance than that of the zipper 168, thereby preventing inadvertent unzipping of the zipper 168.

When inflated, the bladder 160 includes a central portion 180 located behind the user's head and two legs 182 extending therefrom on opposite sides of the user's neck. In the illustrated embodiment, the inflated bladder 160 is generally triangular in shape, with the two legs 182 crossing in front of the user's torso. By providing a flotation bladder 160 behind the user's head and around the user's neck, the system herein further aids in orienting a user generally face up with his or her head out of the water.

Figure 35:
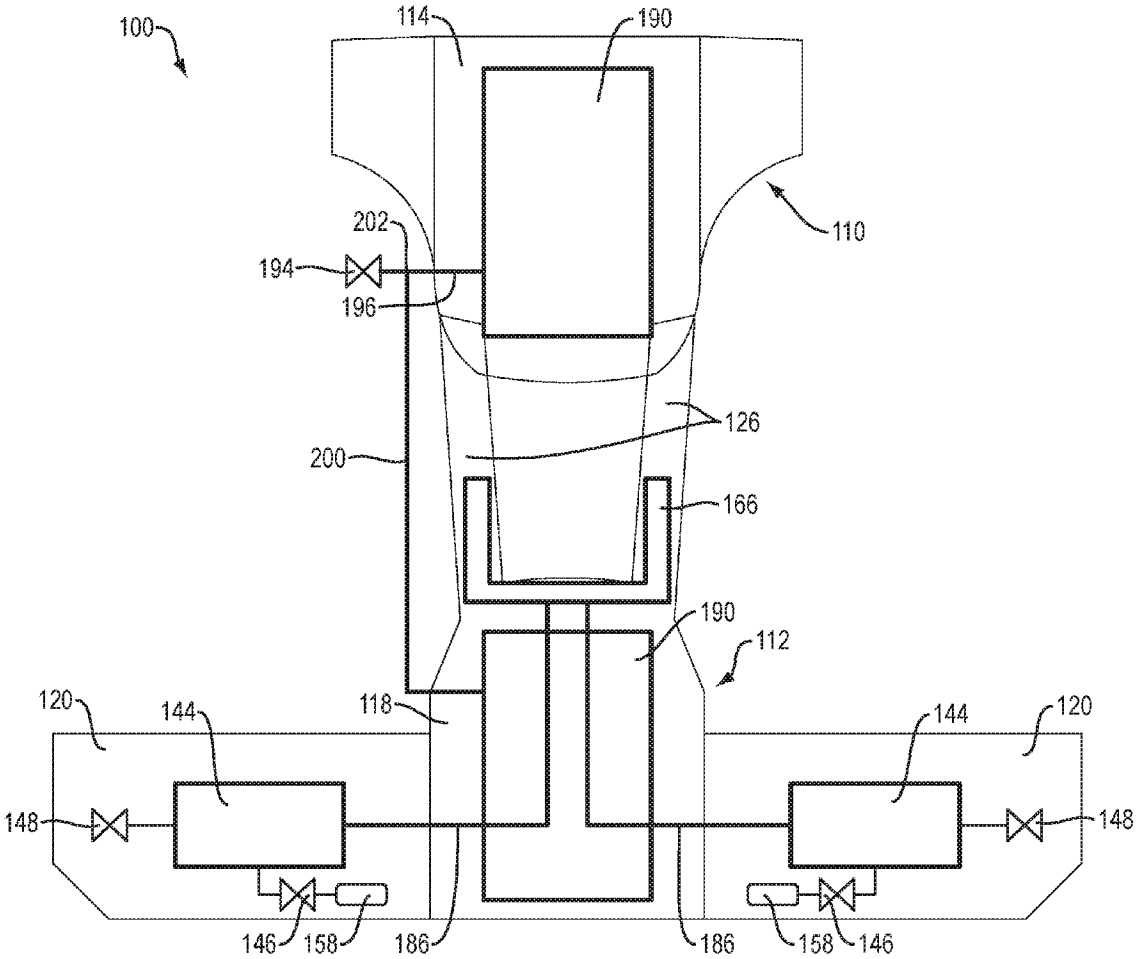
FIG. 35 is a schematic diagram of a preferred embodiment system.

As best seen in FIG. 35, the side bladders 144 and the neck bladder 160 are preferably in fluid communication with each other. In the illustrated embodiment, conduits 186 provide a fluidic coupling between each of the side bladders 144 and the neck bladder 160 such that all bladders can be inflated at the same time using either or both of the oral inflation valves 148 and/or either or both of the sources of compressed gas 158.

In preferred embodiments, the side and neck bladders are configured to provide self-righting flotation that provides about 45 lbs of positive buoyancy in seawater at a depth of 33 ft., 57 lbs of positive flotation at a depth of 15 ft., and 90 lbs of flotation on the surface.

In the illustrated preferred embodiment, the vest system 100 may optionally include an inflatable bladder or buoyancy compensator inserted into a pocket in the front panel 114 and/or a pocket in the rear panel 118. In the illustrated embodiment, a front inflatable buoyancy compensator 190 is received within a pocket formed within the front panel 114, e.g., a pocket adapted to receive a ballistic plate or a like pocket positioned adjacent (and preferably behind) a ballistic plate. Likewise, a rear inflatable buoyancy compensator 192 is received within a pocket formed within the rear panel 118, e.g., within a pocket adapted to receive a ballistic plate or within a like pocket positioned adjacent (and preferably behind) a ballistic plate.

An oral inflation valve 194 is attached to a hose 196 which extends through an opening in the front panel 114 and is coupled to the buoyancy compensator 190. The oral inflation valve should be positioned near the mouth of the wearer. A loop or other fastener 198 may be provided to secure the valve 194 when not in use. A hose 200 extends from the rear buoyancy compensator 192 to the line 196, e.g., via a manifold or T-connector 202. In this manner both the front and rear buoyancy compensator members 190, 192 can be inflated with the valve 194.

In alternative embodiments, the connector 202 can be omitted and each buoyancy compensator 190, 192 can remain separate and fluidically decoupled and inflated individually by the end user.

The buoyancy compensators are inflatable to offset at least a portion of the weight of an equipment load in water. For example, in preferred embodiments, each of the buoyancy compensators is configured to provide about 5 lbs of lift on the surface in seawater when inflated for a total buoyancy compensation capability of 10 lbs of offset. The buoyancy compensators can be deflated via the oral inflation valve when not in use.

The front and rear buoyancy compensators 190 and 192, may be of the same configuration or of different configurations. The front and rear buoyancy compensators 190 and 192, may be as described in prior U.S. patent application Ser. No. 13/770,375 filed Feb. 19, 2013. The front and rear buoyancy compensators 190 and 192 and may include an integral foam panel, a rigid body armor plate, a soft body armor plate, or any combination thereof.

In certain embodiments, the front and rear buoyancy compensators 190 and 192 may include a foam panel (e.g., a closed cell foam panel, impact resistance foam panel, etc.) which is received within the pocket together with a separate hard or soft ballistic insert. The front and rear buoyancy compensators 190 and 192 are advantageously positioned behind (relative to a fired projectile) any separately inserted ballistic insert to reduce back face deformation of the ballistic insert or otherwise reduce the impact force of a non-penetrating projectile.

In certain embodiments, it is contemplated that a hard or soft ballistic layer is integrated into the front and rear buoyancy compensators 190 and 192. In such embodiments, the inflatable bladder portion should be positioned toward the user's body, opposite the strike face of the ballistic layer to reduce back face deformation of the ballistic flotation member or otherwise reduce the impact force of a non-penetrating projectile.

In addition to reducing back face deformation of an associated ballistic insert, in certain embodiments, the inflatable front and rear buoyancy compensators 190 and 192 also provide buoyancy compensation to allow the user to remain neutrally buoyant. In alternative embodiments, the front and rear buoyancy compensators 190 and 192 are configured to provide positive buoyancy. For example, a foam member may be provided to provide neutral buoyancy to the user when the buoyancy compensators 190 and 192 are uninflated and positive buoyancy when the buoyancy compensators 190 and 192 are inflated.

Figure 34:
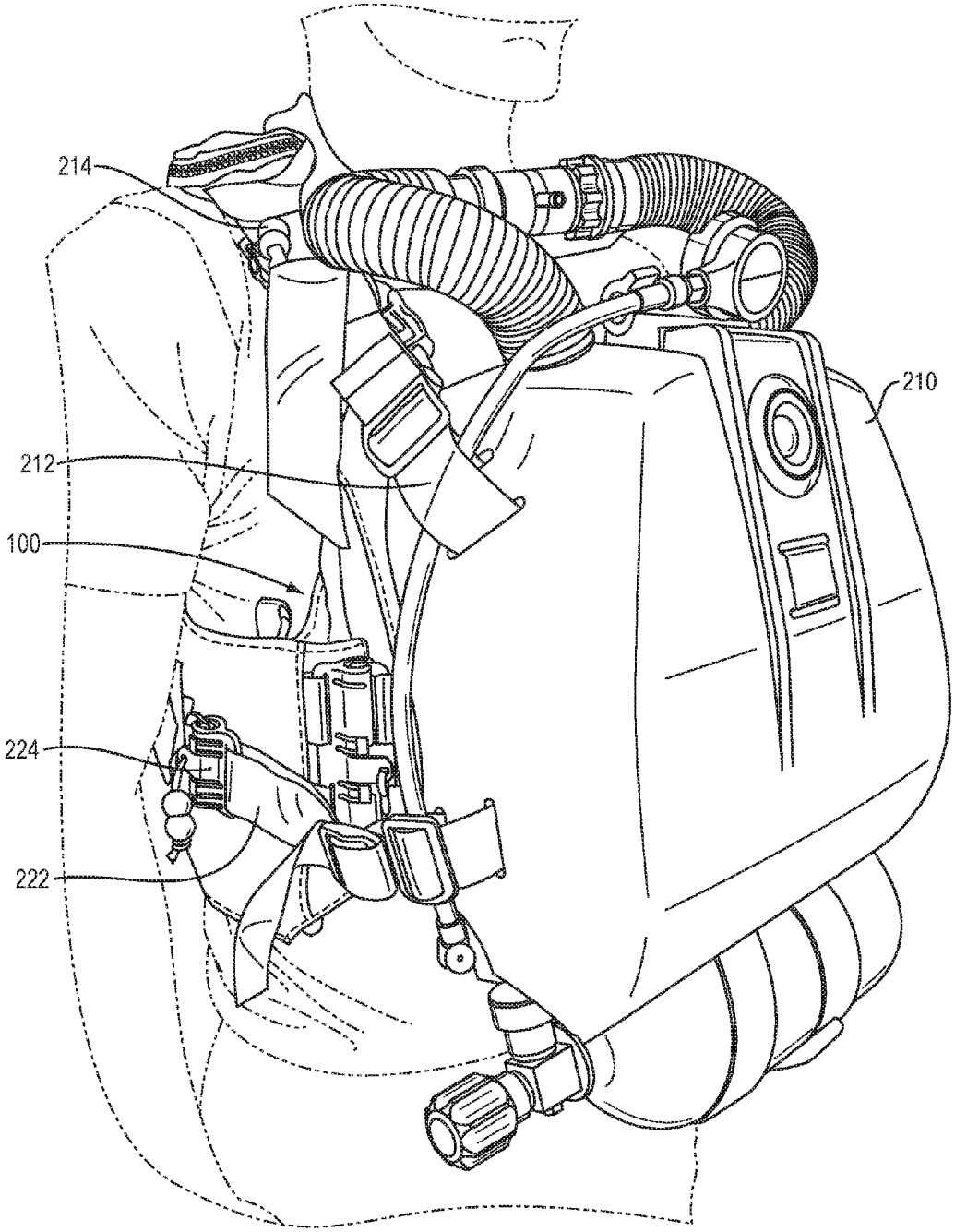
FIG. 34 illustrates the manner of attaching an underwater breathing apparatus.

Referring now to FIG. 34, the illustrated system 100 may advantageously be used with an underwater breathing apparatus 210, such as a self-contained underwater breathing apparatus and preferably a closed circuit rebreather device (e.g., a closed circuit underwater breathing apparatus (CCUBA)).

In the depicted embodiment, a first pair of straps 212 and a second pair of straps 222 removably connect the rebreather device 210 to the vest system 100. A first end of each strap 212 includes a fastener element 214 for removable attachment to complementary fastener element 216 on a respective one of the shoulder straps 126. A first end of each strap 222 includes a fastener element 224 for removable attachment to complementary fastener element 226 on a respective one of the side panels 120. In the illustrated embodiment, the fastener elements 214, 216, 224, and 226, are TUBES™ fasteners available from FirstSpear, LLC, of Fenton, Mo. It will be recognized that other types of fasteners including buckles, clips, snap fasteners, ties, hook and loop fasteners, and the like may also be used. In an especially preferred embodiment, each of the straps 212 and 222 may employ a quick release fastener system to allow rapid attachment and detachment of the rebreather device. Exemplary quick release fastener systems that may be used include side release buckles commercially available from ITW Fastex-U.S. of Des Plaines, Ill. In contrast to prior art devices, the vest system 100 of the present disclosure allows the breathing apparatus 210 to be readily removed independently of the vest system 100. This allows, for example, a user exiting the water to remove the rebreather device 210 without the need to remove the vest system 100.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A tactical garment safety system, comprising:

a front carrier configured to be worn over a front portion of a human torso;

a rear carrier configured to be worn over a rear portion of a human torso;

first and second spaced apart shoulder straps, each of said first and second spaced apart shoulder straps securing an upper end of the front carrier to an upper end of the rear carrier;

a first inflatable member received within the front carrier;

a second inflatable member received within the rear carrier;

a conduit providing a fluidic coupling between the first inflatable member and the second inflatable member; and a first inflation valve in fluid communication with the conduit for inflating the first and second inflatable members.

2. The tactical garment safety system of claim 1, wherein the first inflatable member is removably received within the front carrier and the second inflatable member is removably received within the rear carrier.

3. The tactical garment safety system of claim 1, wherein one or both of the front carrier and the rear carrier include a ballistic resistant layer.

4. The tactical garment safety system of claim 3, wherein the ballistic resistant layer is a removable ballistic plate.

5. The tactical garment safety system of claim 1, wherein one or both of the first inflatable member and the second inflatable member include a ballistic resistant layer.

6. The tactical garment safety system of claim 1, further comprising:

at least one inflatable bladder integrally attached thereto.

7. The tactical garment safety system of claim 1, further comprising:

a first side panel extending between said front carrier and said rear carrier;

a second side panel opposite the first side panel and extending between said front carrier and said rear carrier;

a first inflatable bladder housed within the first side panel when the first inflatable bladder is in a deflated condition;

a second inflatable bladder housed within the second side panel when the second inflatable bladder is in a deflated condition; and one or more inflation valves coupled to one or both of the first inflatable bladder and the second inflatable bladder.

8. The tactical garment safety system of claim 7, wherein said one or more inflation valves includes a first oral inflation valve in fluid communication with the first inflatable bladder and a second oral inflation valve in fluid communication with the second inflatable bladder.

9. The tactical garment safety system of claim 7, further comprising:

a source of compressed gas coupled to one or both of said first inflatable bladder and said second inflatable bladder.

10. The tactical garment safety system of claim 7, further comprising:

a first source of compressed gas coupled to said first inflatable bladder; and a second source of compressed gas coupled to said second inflatable bladder.

11. The tactical garment safety system of claim 10, further comprising:

a first mechanical actuator for fluidically coupling the first source of compressed gas to the first bladder; and a second mechanical actuator for fluidically coupling the second source of compressed gas to the second bladder.

12. The tactical garment safety system of claim 11, wherein each of the first and second mechanical actuators includes a piercing valve including a piercing pin for selectively piercing a respective one of said first and second sources of compressed gas.

13. The tactical garment safety system of claim 10, further comprising:

a first water activated valve for automatically fluidically coupling the first source of compressed gas to the first bladder in the presence of water; and a second water activated valve for automatically fluidically coupling the second source of compressed gas to the second bladder in the presence of water.

14. The tactical garment safety system of claim 7, wherein the first inflatable bladder is in fluid communication with the second inflatable bladder.

15. The tactical garment safety system of claim 1, further comprising an inflatable bladder attached to the rear carrier.

16. The tactical garment safety system of claim 15, wherein the inflatable bladder is positioned behind a head of a wearer donning the tactical garment safety system.

17. The tactical garment safety system of claim 16, wherein the inflatable bladder includes a rear segment extending in a transverse direction behind the head of the wearer, a right leg extending from the rear segment on a right side of the head of the wearer, and a left leg extending from the rear segment on a left side of the head of the wearer.

18. The tactical garment safety system of claim 17, wherein the rear segment, the left leg, and the right leg define a collar substantially encircling the wearer's neck when the inflatable bladder is inflated.

19. The tactical garment safety system of claim 16, further comprising:

a zippered compartment attached to the rear panel, the zippered compartment including a first compartment shell and a second compartment shell, the first and second compartment shells releasably secured with a zipper fastener comprising a plurality of interlocking teeth to define an enclosure receiving the inflatable bladder when the bladder is in a deflated condition.

20. The tactical garment safety system of claim 19, wherein a portion of the zipper fastener is noninterlocking to cause said interlocking teeth to disengage and the first and second compartment shells to separate responsive to an inflation pressure in the inflatable bladder.

21. The tactical garment safety system of claim 1, further comprising:

a first side panel extending between said front carrier and said rear carrier;

a second side panel opposite the first side panel and extending between said front carrier and said rear panel;

a first inflatable bladder housed within the first side panel when the first inflatable bladder is in a deflated condition;

a second inflatable bladder housed within the second side panel when the second inflatable bladder is in a deflated condition;

one or more inflation valves coupled to one or both of the first inflatable bladder and the second inflatable bladder; and a third inflatable bladder attached to the rear carrier.

22. The tactical garment safety system of claim 21, further comprising a whistle attached thereto.

23. The tactical garment safety system of claim 21, further comprising one or both of a whistle attached to the first side bladder and a whistle attached to the second side bladder.

24. The tactical garment safety system of claim 21, wherein the third inflatable bladder is in fluid communication with one or both of the first inflatable bladder and the second inflatable bladder.

25. The tactical garment safety system of claim 24, wherein the third inflatable bladder is in fluid communication with a valve inlet on one or both of the first inflatable bladder and the second inflatable bladder.

26. The tactical garment safety system of claim 24, wherein the third inflatable bladder is in fluid communication with a source of inflation gas coupled to one or both of the first inflatable bladder and the second inflatable bladder.

27. The tactical garment safety system of claim 24, wherein the third inflatable bladder is in fluid communication with a first source of inflation gas coupled to the first inflatable bladder and a second source of inflation gas coupled to the second inflatable bladder.

28. The tactical garment safety system of claim 21, wherein the first inflatable bladder is positioned under a first arm of a wearer donning the tactical garment safety system, the second inflatable bladder is positioned under a second arm of the wearer, and the third inflatable bladder is positioned behind the head of the wearer.

29. The tactical garment safety system of claim 28, wherein the third inflatable bladder includes a rear segment extending in a transverse direction behind a head of the wearer, a right leg extending from the rear segment on the right side of the head of the wearer, and a left leg extending from the rear segment on the left side of a head of the wearer.

30. The tactical garment safety system of claim 29, wherein the rear segment, the left leg, and the right leg define a collar substantially encircling the wearer's neck when the inflatable bladder is inflated.

31. The tactical garment safety system of claim 21, further comprising:

a zippered compartment attached to the rear panel, the zippered compartment including a first compartment shell and a second compartment shell, the first and compartment shells releasably secured with a zipper fastener comprising a plurality of interlocking teeth to define an enclosure receiving the inflatable bladder when the bladder is in a deflated condition.

32. The tactical garment safety system of claim 31, wherein a portion of the zipper fastener is noninterlocking to cause said interlocking teeth to disengage and the first and second compartment shells to separate responsive to an inflation pressure in the inflatable bladder.

33. The tactical garment safety system of claim 21, further comprising a first inflatable member received within the front carrier and a second inflatable member received within the rear carrier.

34. The tactical garment safety system of claim 33, wherein said first inflatable member is fluidically coupled to the second inflatable member.

35. The tactical garment safety system of claim 21, further comprising:

the first inflatable bladder having a first portion extending in front of the wearer and a second portion extending behind the wearer when the first inflatable bladder is inflated;

the second inflatable bladder having a third portion extending in front of the wearer and a fourth portion extending behind the wearer when the second inflatable bladder is inflated;

a first fastener disposed on the first portion;

a second fastener disposed on the third portion; and the first and second fastener elements being releasably attachable to each other to fasten the first portion to the third portion in front of the torso of the wearer when the first and second side bladders are inflated.

36. The tactical garment safety system of claim 35, wherein one or both of the first fastener and the second fastener incorporates a whistle.

37. The tactical garment safety system of claim 35, further comprising:

a first pocket formed in the first portion, the first pocket removably receiving the first fastener; and a second pocket formed in the third portion, the second pocket removably receiving the second fastener.

38. The tactical garment safety system of claim 37, wherein the first fastener comprises a male side release fastener and the second fastener comprises a female side release fastener complementary with the male side release fastener.

39. The tactical garment safety system of claim 37, further comprising a first strap securing the first fastener to the first side bladder and a second strap securing the second fastener to the second side bladder.

40. The tactical garment safety system of claim 39, wherein at least one of the first and second straps has an adjustable length.

41. The tactical garment safety system of claim 37, further comprising a whistle received in one or both of the first and second pockets.

42. The tactical garment safety system of claim 35, wherein one or both of the first fastener and the second fastener is removably attachable to a fastener on a like tactical garment safety system.

43. A tactical garment safety system, comprising:

a front carrier configured to be worn over a front portion of a human torso;

a rear carrier configured to be worn over a rear portion of a human torso;

first and second spaced apart shoulder straps, each of said first and second spaced apart shoulder straps securing an upper end of the front carrier to an upper end of the rear carrier;

a first side panel extending between said front carrier and said rear carrier;

a second side panel opposite the first side panel and extending between said front panel and said rear panel;

a first inflatable bladder housed within the first side panel when the first inflatable bladder is in a deflated condition;

a second inflatable bladder housed within the second side panel when the second inflatable bladder is in a deflated condition;

the first inflatable bladder having a first portion extending in front of a wearer and a second portion extending behind the wearer when the first inflatable bladder is inflated;

the second inflatable bladder having a third portion extending in front of the wearer and a fourth portion extending behind the wearer when the second inflatable bladder is inflated;

a first fastener disposed on the first portion;

a second fastener disposed on the third portion; and the first and second fastener elements being releasably attachable to each other to fasten the first portion to the third portion in front of the torso of the wearer.

44. The tactical garment safety system of claim 43, wherein the first portion is larger than the second portion and the third portion is larger than the fourth portion.

45. The tactical garment safety system of claim 43, further comprising:

a first pocket formed in the first portion, the first pocket removably receiving the first fastener; and a second pocket formed in the third portion, the second pocket removably receiving the second fastener.

46. The tactical garment safety system of claim 45, wherein the first fastener comprises a male side release fastener and the second fastener comprises a female side release fastener complementary with the male side release fastener.

47. The tactical garment safety system of claim 45, further comprising a first strap securing the first fastener to the first side bladder and a second strap securing the second fastener to the second side bladder.

48. The tactical garment safety system of claim 47, wherein at least one of the first and second straps has an adjustable length.

49. The tactical garment safety system of claim 45, further comprising one or more whistles selected from the group consisting of a whistle received in one or both of the first and second pockets and a whistle incorporated into one or both of the first fastener and the second fastener.

50. The tactical garment safety system of claim 43, wherein one or both of the first fastener and the second fastener is removably attachable to a fastener on a like tactical garment safety system.

* * * * *